US012000633B2

(12) United States Patent
Adachi et al.

(10) Patent No.: US 12,000,633 B2
(45) Date of Patent: Jun. 4, 2024

(54) OUTDOOR UNIT AND AIR-CONDITIONING APPARATUS

(71) Applicant: Mitsubishi Electric Corporation, Tokyo (JP)

(72) Inventors: Rihito Adachi, Tokyo (JP); Yoji Onaka, Tokyo (JP); Takashi Matsumoto, Tokyo (JP); Hiroyuki Okano, Tokyo (JP); Takeshi Hatomura, Tokyo (JP); Kazuki Okochi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 404 days.

(21) Appl. No.: 17/423,120

(22) PCT Filed: Jan. 21, 2019

(86) PCT No.: PCT/JP2019/001630
§ 371 (c)(1),
(2) Date: Jul. 15, 2021

(87) PCT Pub. No.: WO2020/152738
PCT Pub. Date: Jul. 30, 2020

(65) Prior Publication Data

US 2022/0128279 A1 Apr. 28, 2022

(51) Int. Cl.
*F25B 41/42* (2021.01)
*F28F 9/02* (2006.01)

(52) U.S. Cl.
CPC ..... *F25B 41/42* (2021.01); *F28F 9/0246* (2013.01); *F28F 9/026* (2013.01); *F25B 2339/00* (2013.01); *F25B 2500/09* (2013.01)

(58) Field of Classification Search
CPC .. F25B 41/42; F25B 2339/00; F25B 2500/09; F25B 39/04; F25B 39/028; F25B 13/00;
(Continued)

(56) References Cited

U.S. PATENT DOCUMENTS 5,626,031 A 5/1997 Motohashi et al.
2006/0137381 A1* 6/2006 Choi ..... F25B 13/00 62/324.1

(Continued)

FOREIGN PATENT DOCUMENTS

EP 3128263 A1 2/2017
JP 56-157770 A 12/1981

(Continued)

OTHER PUBLICATIONS

International Search Report and Written Opinion dated Apr. 9, 2019, received for PCT Application PCT/JP2019/001630, Filed on Jan. 21, 2019, 16 pages including English Translation.

(Continued)

*Primary Examiner* — Emmanuel E Duke
(74) *Attorney, Agent, or Firm* — XSENSUS LLP

(57) ABSTRACT

A heat exchanger includes a plurality of heat transfer tubes, a liquid header distributor, and a gas header distributor. The heat transfer tubes include U-shaped bent portions. The heat exchanger includes a heat exchanger core. A relationship between the liquid header distributor and the plurality of heat transfer tubes is established such that $9 \leq \zeta$ is satisfied, where Lh [m] is the length of the liquid header distributor, Lb [m] is the length of the shortest one of the heat transfer tubes, and $\zeta$ is the ratio of the length Lb of the shortest heat transfer tube to the length Lh of the liquid header distributor and is expressed by $\zeta = Lb/Lh$.

13 Claims, 18 Drawing Sheets

(58) Field of Classification Search
CPC ..... F25B 2313/0233; F25B 2500/01; F28F 9/0246; F28F 9/026; F28D 1/024; F28D 1/0443; F28D 1/0475; F28D 1/0477; F24F 1/18
See application file for complete search history.

(56) References Cited

U.S. PATENT DOCUMENTS

| | | | |
|---|---|---|---|
| 2016/0341453 | A1 | 11/2016 | Yamashita |
| 2019/0162454 | A1 | 5/2019 | Hatomura et al. |

FOREIGN PATENT DOCUMENTS

| | | | | | |
|---|---|---|---|---|---|
| JP | 5-18692 | A | | 1/1993 | |
| JP | 5-203285 | A | | 8/1993 | |
| JP | 5-83671 | U | | 11/1993 | |
| JP | 8-247576 | A | | 9/1996 | |
| JP | 2007-263490 | A | | 10/2007 | |
| JP | 2010-190541 | A | | 9/2010 | |
| JP | 2014-102009 | A | | 6/2014 | |
| JP | 2014-115057 | A | | 6/2014 | |
| JP | 2014-231943 | A | | 12/2014 | |
| JP | 2018-44759 | A | | 3/2018 | |
| JP | 2018044759 | A | * | 3/2018 | |
| WO | 2015/133626 | A1 | | 9/2015 | |
| WO | 2015/140886 | A1 | | 9/2015 | |
| WO | WO-2015140886 | A1 | * | 9/2015 | ..... C09K 5/045 |
| WO | WO-2016208042 | A1 | * | 12/2016 | ..... F24F 1/18 |
| WO | 2017/068723 | A1 | | 4/2017 | |
| WO | 2018/047416 | A1 | | 3/2018 | |

OTHER PUBLICATIONS

Notice of Reasons for Refusal dated Sep. 17, 2019, received for JP Application 2019-533254, 14 pages including English Translation.

* cited by examiner

Comparative Example

OUTDOOR UNIT AND AIR-CONDITIONING APPARATUS

CROSS-REFERENCE TO RELATED APPLICATION

The present application is based on PCT filing PCT/JP2019/001630, filed Jan. 21, 2019, the entire contents of which are incorporated herein by reference.

TECHNICAL FIELD

The present disclosure relates to a heat exchanger including a plurality of heat transfer tubes and two header distributors, and also to an air-conditioning apparatus.

BACKGROUND ART

In the past, regarding a heat exchanger that is applied to, for example, an air-conditioning apparatus, a refrigerant distribution technique has been provided as a technique for causing two-phase gas-liquid refrigerant to flow in a plurality of heat transfer tubes connected to a header distributor, which is a refrigerant distributor. In this technique, distribution characteristics, such as the amounts of liquid refrigerant that flows through the heat transfer tubes, vary depending on flow resistances in the header distributor and the heat transfer tubes and pressure losses caused by the flow resistances. This affects a heat exchange performance. In addition, the heat exchange performance is affected not only by the refrigerant distribution characteristics but also by the pressure losses in the header distributor and the heat transfer tubes.

Therefore, in a technique disclosed in Patent Literature 1, refrigerant that is made to branch from a first header distributor into streams to flow into a plurality of heat transfer tubes, and the streams are then re-collected into single refrigerant to flow in a second header distributor. In this case, an adverse effect on the distribution of the refrigerant at the first header distributor do not affect a downstream side.

CITATION LIST

Patent Literature

Patent Literature 1: Japanese Unexamined Patent Application Publication No. 2010-190541

SUMMARY OF INVENTION

Technical Problem

However, any of heat exchangers has a problem that when the flow rate of the refrigerant that flows into the header distributor varies, the refrigerant distribution characteristics are worsened and the heat exchange performance is deteriorated. In particular, when the flow rate of refrigerant is low, the heat exchange performance is remarkably deteriorated. Therefore, the specifications of the heat exchanger need to be changed each time a flow rate range of the refrigerant that flows through the heat exchanger is changed.

The present disclosure is applied to solve the above problem, and relates to a heat exchanger the specifications of which do not need to be changed each time the flow rate of refrigerant is changed or the kind of the refrigerant to be used is changed and also to an-air conditioning apparatus provided with such a heat exchanger.

Solution to Problem

A heat exchanger according to an embodiment of the present disclosure includes: a plurality of heat transfer tubes; a liquid header distributor to which one end of each of the plurality of heat transfer tubes is connected and in which an upward flow of two-phase gas-liquid refrigerant is generated; and a gas header distributor to which an other end of each of the plurality of heat transfer tubes is connected and in which a flow of gas phase refrigerant is generated. The plurality of heat transfer tubes include U-shaped bent portions at each of which a flow passage is bent. The heat exchanger includes a heat exchanger core that includes the plurality of heat transfer tubes and one or more fins. A relationship between the liquid header distributor and the plurality of heat transfer tubes is established such that $9 \leq \zeta$ is satisfied, where Lh [m] is a length of the liquid header distributor that corresponds to a distance between a central axis of one of the plurality of heat transfer tubes that is the closest to an inlet of the liquid header distributor and a central axis of one of the plurality of heat transfer tubes that is the farthest from the inlet of the liquid header distributor, Lb [m] is a length of a shortest one of the plurality of heat transfer tubes, the length Lb of the shortest one of the plurality of heat transfer tubes corresponding to a distance by which the shortest one of the plurality of heat transfer tubes, which extends from the liquid header distributor to the gas header distributor through the heat exchanger core and the U-shaped bent portions, extends through the heat exchanger core, and $\zeta$ is a ratio of the length Lb of the shortest one of the plurality of heat transfer tubes to the length Lh of the liquid header distributor and is expressed by $\zeta = Lb/Lh$.

An air-conditioning apparatus according to another embodiment of the present disclosure includes the heat exchanger.

Advantageous Effects of Invention

In the heat exchanger and the air-conditioning apparatus according to the embodiments of the present disclosure, $9 \leq \zeta$ is satisfied, where the ratio $\zeta$ of the length Lb of the shortest one of the heat transfer tubes to the length Lh of the liquid header distributor is expressed by $\zeta = Lb/Lh$. Accordingly, the ratio of the flow resistance in the liquid header distributor to the flow resistance in the heat transfer tubes is sufficiently small. Therefore, the influence of the flow resistance in the liquid header distributor on the distribution of the refrigerant can be reduced, an adverse effect on the refrigerant distribution characteristics that is caused when the flow rate of the refrigerant changes can be reduced, and the deterioration of the heat exchange performance can be reduced. As a result, it is not necessary to change the specifications of the heat exchanger each time the flow rate of refrigerant or the type of the refrigerant that is used is changed.

DESCRIPTION OF EMBODIMENTS

Embodiments of the present disclosure will be described with reference to the figures. In each of the figures, components that are the same as or equivalent to those in a previous figure or figures are denoted by the same reference signs. The same is true of the entire text of the specification. In sectional views, hatching is omitted as appropriate for visibility. Configurations of components described in the specification are merely examples, and such descriptions are not limiting.

Embodiment 1

<Heating Operation of Air-Conditioning Apparatus>

Figure 1:
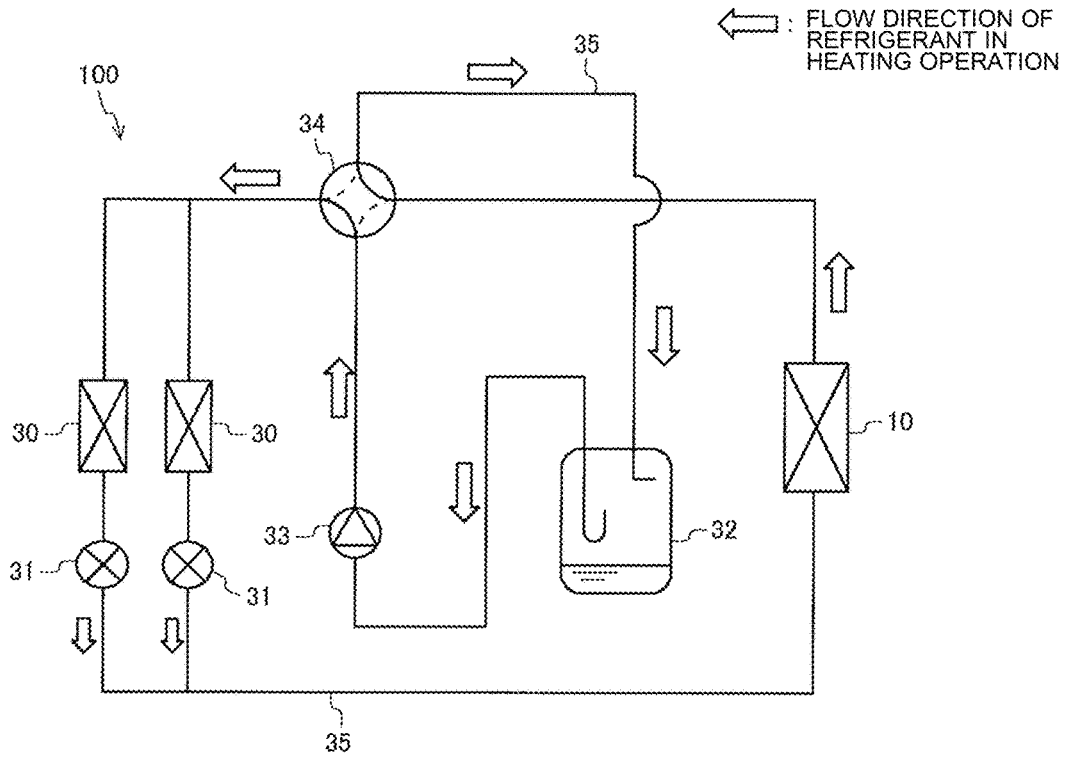
FIG. 1 is an explanatory view illustrating a configuration of a refrigerant circuit of an air-conditioning apparatus according to Embodiment 1 of the present disclosure in a heating operation.

FIG. 1 illustrates a configuration of a refrigerant circuit of an air-conditioning apparatus 100 according to Embodiment 1 of the present disclosure in a heating operation. The air-conditioning apparatus 100 as illustrated in FIG. 1 includes an outdoor heat exchanger 10, indoor heat exchangers 30, a compressor 33, an accumulator 32, expansion devices 31, and a four-way valve 34. These components are connected to each other by refrigerant pipes 35 to form a refrigerant circuit in which refrigerant flows.

As illustrated in FIG. 1, first, low-temperature and low-pressure gas refrigerant is sucked in by the compressor 33, and is compressed into high-temperature and high-pressure gas refrigerant. The high-temperature and high-pressure gas refrigerant is discharged from the compressor 33, passes through the four-way valve 34, and then flows into the indoor heat exchangers 30.

The high-temperature and high-pressure gas refrigerant that has flowed into the indoor heat exchangers 30 exchanges heat with air supplied by indoor fans, and as a result transfers heat and condenses to change into high-temperature and high-pressure liquid refrigerant. The high-temperature and high-pressure liquid refrigerant then flows out of the indoor heat exchangers 30.

The liquid refrigerant that has flowed out of the indoor heat exchangers 30 is expanded and reduced in pressure at the expansion devices 31 to change into low-temperature and low-pressure two-phase gas-liquid refrigerant. The low-temperature and low-pressure two-phase gas-liquid refrigerant then flows into the outdoor heat exchanger 10.

The two-phase gas-liquid refrigerant that has flowed into the outdoor heat exchanger 10 exchanges heat with outdoor air supplied by an outdoor fan 36, which will be described below, and as a result receives heat and evaporates to change into low-temperature and low-pressure gas refrigerant. The low-temperature and low-pressure gas refrigerant then flows out of the outdoor heat exchanger 10.

The low-temperature and low-pressure gas refrigerant passes through the accumulator 32, and is re-sucked by the compressor 33. Then, the refrigerant is re-compressed and re-discharged. The above circulation of the refrigerant is repeated.

<Cooling Operation of Air-Conditioning Apparatus>

Figure 2:
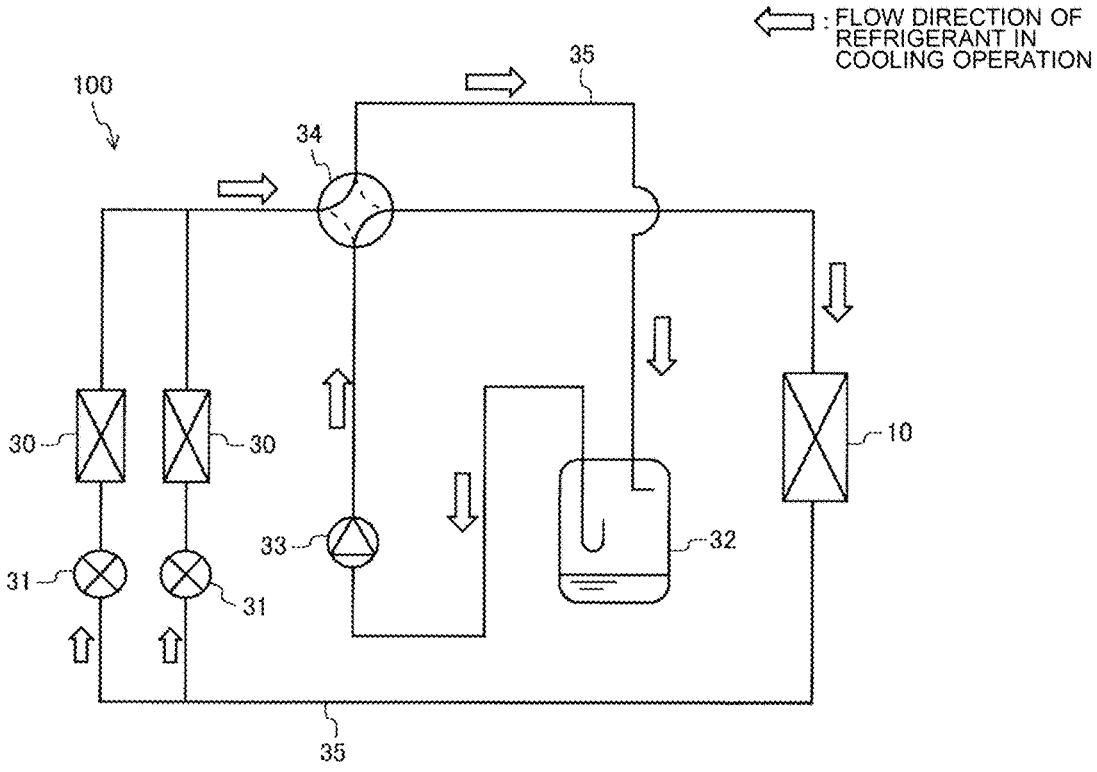
FIG. 2 is an explanatory view illustrating a configuration of the refrigerant circuit of the air-conditioning apparatus according to Embodiment 1 of the present disclosure in a cooling operation.

FIG. 2 is an explanatory view illustrating a configuration of the refrigerant circuit of the air-conditioning apparatus 100 according to Embodiment 1 of the present disclosure in a cooling operation. As illustrated in FIG. 2, first, low-temperature and low-pressure gas refrigerant is sucked by the compressor 33, and is compressed into high-temperature and high-pressure gas refrigerant. The high-temperature and high-pressure gas refrigerant is then discharged from the compressor 33, passes through the four-way valve 34, and then flows into the outdoor heat exchanger 10.

The high-temperature and high-pressure gas refrigerant that has flowed into the outdoor heat exchanger 10 exchanges heat with air supplied by the outdoor fan 36, and as a result transfers heat and condenses to change into high-temperature and high-pressure liquid refrigerant. The high-temperature and high-pressure liquid refrigerant then flows out of the outdoor heat exchanger 10.

The liquid refrigerant that has flowed out of the outdoor heat exchanger 10 is expanded and reduced in pressure at the expansion devices 31 to change into low-temperature and low-pressure two-phase gas-liquid refrigerant. The low-temperature and low-pressure two-phase gas-liquid refrigerant then flows into the indoor heat exchangers 30.

The two-phase gas-liquid refrigerant that has flowed into the indoor heat exchangers 30 exchanges heat with indoor air supplied by the indoor fans, and as a result receives heat and evaporates to change into low-temperature and low-pressure gas refrigerant. The low-temperature and low-pressure gas refrigerant then flows out of the indoor heat exchangers 30.

The low-temperature and low-pressure gas refrigerant passes through the accumulator 32 and is re-sucked by the compressor 33. Then, the refrigerant is re-compressed and re-discharged. The above circulation of the refrigerant is repeated.

The number of indoor heat exchangers 30 and the number of outdoor heat exchangers 10 are not limited to those as illustrated in FIGS. 1 and 2, and may be determined depending on an environment in which a refrigeration cycle apparatus is installed.

<Configuration of Outdoor Heat Exchanger 10>

Figure 3:
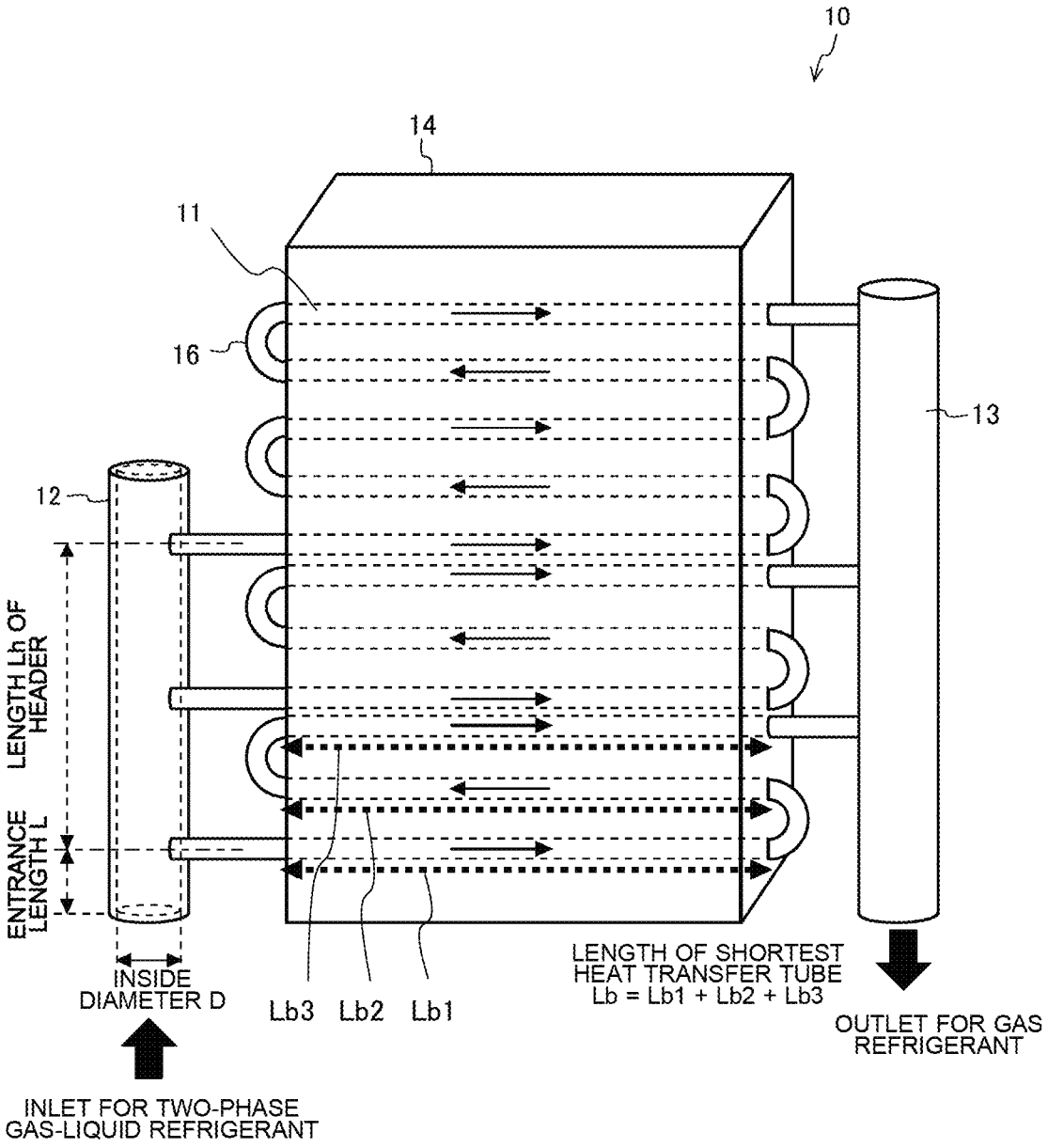
FIG. 3 is an explanatory view illustrating a configuration of an outdoor heat exchanger according to Embodiment 1 of the present disclosure.

FIG. 3 is an explanatory view illustrating a configuration of the outdoor heat exchanger 10 according to Embodiment 1 of the present disclosure. The outdoor heat exchanger 10 as illustrated in FIG. 3 will be described, referring to by way of example the case where the outdoor heat exchanger 10 operates as an evaporator. It should be noted that the outdoor heat exchanger 10 may operate as a condenser. When the outdoor heat exchanger 10 operates as a condenser, the refrigerant flows in the opposite direction to the flow direction of the refrigerant in the case where the outdoor heat exchanger 10 operates as an evaporator.

Instead of the outdoor heat exchanger 10 as described below, the indoor heat exchanger 30 may be used. Each of the outdoor heat exchanger 10 and the indoor heat exchangers 30 will also be referred to simply as a heat exchanger.

Figure 4:
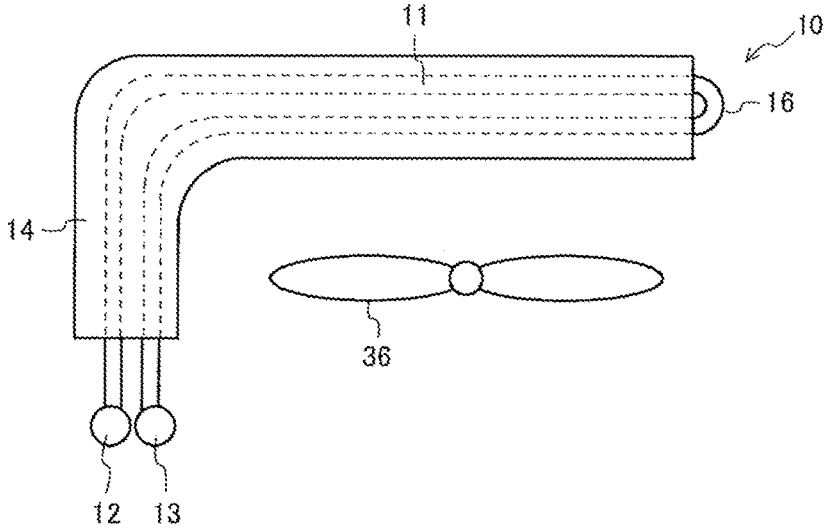
FIG. 4 is a top view illustrating the configuration of the outdoor heat exchanger according to Embodiment 1 of the present disclosure.

The outdoor heat exchanger 10 includes a plurality of heat transfer tubes 11, a liquid header distributor 12, a gas header distributor 13, and a heat exchanger core 14. FIG. 3 illustrates an example in which the heat transfer tubes 11 are arranged in two rows, as illustrated in FIG. 4 which will be referred to below. However, the number of rows of the heat transfer tubes 11 is not limited to two, and may be one or three or more.

The heat transfer tubes 11 extend straight in the heat exchanger core 14. Each of the heat transfer tubes 11 includes one or more U-shaped bent portions 16 at each of which a flow passage is bent in a direction other than a horizontal direction. That is, each of the heat transfer tubes 11 passes through the heat exchanger core 14 two or more times. The U-shaped bent portions 16 are located outside the heat exchanger core 14.

To the liquid header distributor 12, one end of each of the heat transfer tube 11 is connected, and an upward flow of two-phase gas-liquid refrigerant is generated in the liquid header distributor 12. That is, the liquid header distributor 12 causes the two-phase gas-liquid refrigerant to flow upward.

To the gas header distributor 13, the other end of each heat transfer tube 11 is connected, and a downward flow of gas phase refrigerant is generated in the gas header distributor 13. That is, the gas header distributor 13 causes gas phase refrigerant to flow downward.

Since the liquid header distributor 12 causes the two-phase gas-liquid refrigerant to flow upward, and the gas header distributor 13 causes the gas phase refrigerant to flow downward, the liquid header distributor 12 is located at a lower position than the gas header distributor 13.

The heat exchanger core 14 includes the heat transfer tubes 11 and a plurality of heat transfer fins (not illustrated) disposed between the heat transfer tubes 11. The heat transfer tubes 11 are circular tubes in which flow passages having a circular cross section are provided or flat tubes in which flow passages having an elongated cross section are provided. The refrigerant flows through the heat transfer tubes 11. The refrigerant in the heat transfer tubes 11 exchanges heat with air that flows in a region located outside the heat transfer tubes 11. The heat transfer tubes 11 extend straight in the heat exchanger core 14. The heat transfer fins are one or more metal members that are, for example, formed in the shape of plates. The shape of each of the heat transfer fins is not limited, and the heat transfer fins may be elongated or corrugated.

In the heat exchanger core 14, the plurality of heat transfer tubes 11 are arranged such that at least one heat transfer tube 11 located at an upper portion of the liquid header distributor 12 includes a larger number of U-shaped bent portions 16 than at least one heat transfer tube 11 located at a lower portion of the liquid header distributor 12. Alternatively, in the heat exchanger core 14, the plurality of heat transfer tubes may be arranged such that at least one heat transfer tube 11 located from an intermediate portion of the liquid header distributor 12 to the upper portion of the liquid header distributor 12 includes a larger number of U-shaped bent portions 16 than at least one heat transfer tube 11 located at the lower portion of the liquid header distributor 12.

The liquid header distributor 12 and the gas header distributor 13 include tubes that are thicker than the heat transfer tubes 11. The heat transfer tubes 11 are connected to the liquid header distributor 12 and the gas header distributor 13 such that the heat transfer tubes 11 are arranged and spaced from each other in a longitudinal direction of the liquid header distributor 12 and the gas header distributor 13. The two-phase gas-liquid refrigerant that flows through the liquid header distributor 12 in the longitudinal direction is distributed to the heat transfer tubes 11 in turn. The liquid header distributor 12 distributes refrigerant that is provided mainly as two-phase gas-liquid refrigerant and also contains liquid refrigerant, to the heat transfer tubes 11. The refrigerant evaporates to change into gas phase refrigerant in the heat transfer tubes 11, and is collected in the gas header distributor 13. Then, the refrigerant passes through the accumulator 32 and is sucked by the compressor 33.

In the example illustrated in FIG. 3, the two-phase gas-liquid refrigerant flows upward from the lower portion of liquid header distributor 12, and is distributed to heat transfer tubes 11 inserted in the liquid header distributor 12. Then, the refrigerant is subjected to heat exchange in the heat exchanger core 14 to evaporate and change into gas phase refrigerant. The gas phase refrigerant flows into the gas header distributor 13, then flows in the gas header distributor 13 in a vertically downward direction, and flows out from the lower portion of the gas header distributor 13.

The heat transfer tubes 11 in which flow passages extend from the liquid header distributor 12 to the gas header distributor 13 include U-shaped bent portions 16 that are bent upward in such a manner as to be U-shaped. Each of the heat transfer tubes 11 includes one or more U-shaped bent portions 16. The U-shaped bent portions 16 are bent in such a manner as to be U-shaped, in a direction other than the horizontal direction, for example, in a vertical direction or an obliquely upward or downward direction.

Referring to FIG. 3, a length Lb of the shortest one of the heat transfer tubes 11 is the sum of a length Lb1 of part of a heat transfer tube 11 that is located in the heat exchanger core 14, a length Lb2 of another part of the heat transfer tube 11 that is located in the heat exchanger core 14, and a length Lb3 of still another part of the heat transfer tube 11 that is located in the heat exchanger core 14 (Lb=Lb1+Lb2+Lb3).

<Shape of Outdoor Heat Exchanger 10>

FIG. 4 is a top view illustrating the configuration of the outdoor heat exchanger 10 according to Embodiment 1 of the present disclosure. As illustrated in FIG. 4, the heat exchanger core 14 included in the outdoor heat exchanger 10 is bent to have an L-shape. The outdoor fan 36 is provided inward of an inward one of surfaces of the heat exchanger core 14, which has a smaller exposure area.

The heat exchanger core 14 may be bent two or more times to have a U-shape or a rectangular shape, or have a flat plate shape with no bent portion, depending on the shape of a housing.

COMPARATIVE EXAMPLE

Figure 5:
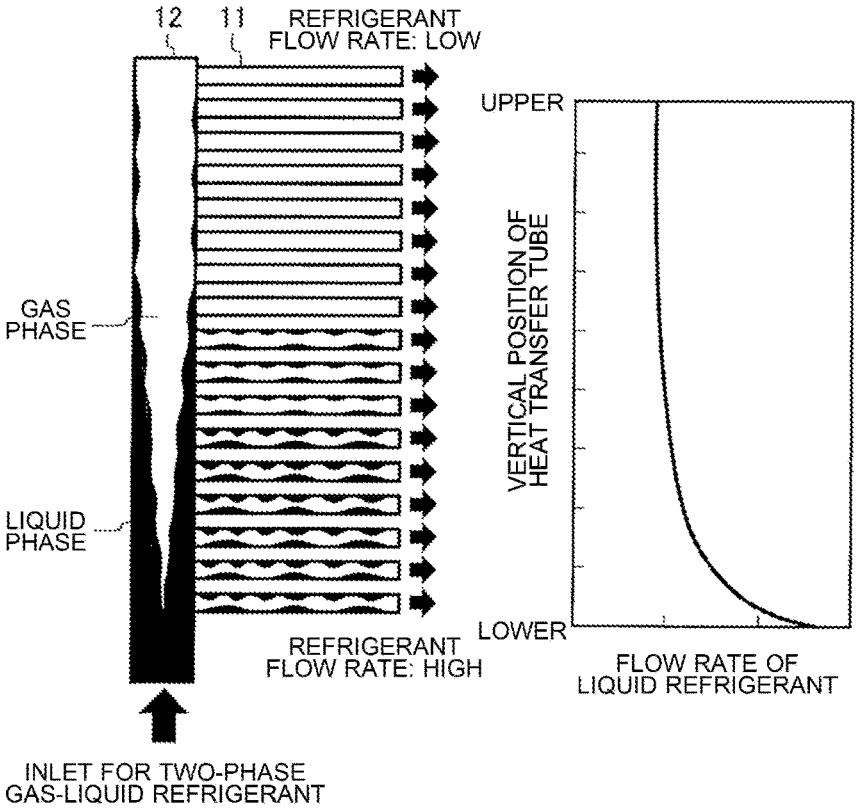
FIG. 5 is an explanatory view indicating flow rates of refrigerant in a liquid header distributor and a plurality of heat transfer tubes of a comparative example under a condition in which the flow rate of refrigerant is low.

FIG. 5 is an explanatory view indicating flow rates of refrigerant in a liquid header distributor 12 and a plurality of heat transfer tubes 11 of a comparative example under a condition in which the flow rate of refrigerant is low. Referring to FIG. 5, a pressure loss in the liquid header distributor 12 is caused mainly by a frictional resistance and a flow resistance due to gravity. A pressure loss in each heat transfer tube 11 is caused mainly by a frictional resistance. Therefore, a flow resistance, which is caused by gravity, to refrigerant that flows through the passage in the at least one heat transfer tube 11 connected to the lower portion of the liquid header distributor 12 is lower than that to refrigerant that flows through the passage in the at least one heat transfer tube 11 connected to the upper portion of the liquid header distributor 12. In such a manner, the flow resistance to the refrigerant that flows through the passage in the at least one the heat transfer tube 11 connected to the lower portion of the liquid header distributor 12 is low, and the refrigerant thus tends to flow at a high flow rate.

In the comparative example, which corresponds to the related art, when two-phase gas-liquid refrigerant that flows upward from the lower portion of the liquid header distributor 12 at a low flow rate is distributed to the heat transfer tubes 11, the refrigerant also flows in the plurality of heat exchanger tubes 11 at a low flow rate. As a result, the pressure loss in the heat transfer tubes 11 is remarkably low, and the ratio of the pressure loss due to gravity in the liquid header distributor 12 is relatively high. Therefore, liquid refrigerant does not easily flow to the upper portion of the liquid header distributor 12, and the liquid refrigerant concentratedly flows to the lower portion of the liquid header distributor 12. As a result, the amount of heat exchange at the at least one heat transfer tube 11 connected to the upper portion of the liquid header distributor 12 is reduced, and the heat exchange performance is reduced.

<Features of Embodiment 1>

In contrast, according to Embodiment 1, as illustrated in FIG. 3, a relationship between the liquid header distributor 12 and the heat transfer tubes 11 is established such that $9 \leq \zeta$ is satisfied, where Lh [m] is the length of the liquid header distributor 12, Lb [m] is the length of the shortest one of the heat transfer tubes 11, and $\zeta$ is the ratio of the length Lb of the shortest one of the heat transfer tubes 11 to the length Lh of the liquid header distributor 12 and is expressed by $\zeta = Lb/Lh$.

The length Lb of the shortest heat transfer tube 11 corresponds to a distance by which the shortest heat transfer tube 11, which extends from the liquid header distributor 12 to the gas header distributor 13 through the heat exchanger core 14 and the U-shaped bent portions 16, extends through the heat exchanger core 14. In other words, referring to FIG. 3, the length Lb of the shortest heat transfer tube 11 is the sum of the length Lb1 corresponding to a distance by which part of the heat transfer tube 11 extends through the heat exchanger core 14, the length Lb2 corresponding to a distance by which another part of the heat transfer tube 11 extends through the heat exchanger core 14, and the length Lb3 corresponding to a distance by which still another part of the heat transfer tube 11 extends through the heat exchanger core 14 (Lb=Lb1+Lb2+Lb3).

The length Lh of the liquid header distributor 12 corresponds to the distance between the central axis of one of the heat transfer tubes 11 that is the closest to the inlet of the liquid header distributor 12 and the central axis of one of the heat transfer tube 11 that is the farthest from the inlet of the liquid header distributor 12.

Because of the above features, the influence of the flow resistance due to gravity in the liquid header distributor 12 can be sufficiently reduced, as compared with the influence of the flow resistance due to friction in the heat transfer tubes 11. Therefore, the refrigerant does not concentratedly flow to the lower portion of the liquid header distributor 12, and the refrigerant easily flows to the upper portion of the liquid header distributor 12.

Therefore, when the flow rate of refrigerant is low, the adverse effect on the distribution of the refrigerant can be reduced, and deterioration of the heat exchange performance can also be reduced. Therefore, even when the flow rate range is changed or when the refrigerant is replaced by new one, it is not necessary to change the specifications of the heat exchanger.

<Performance Evaluation of Embodiment 1>

Figure 6:
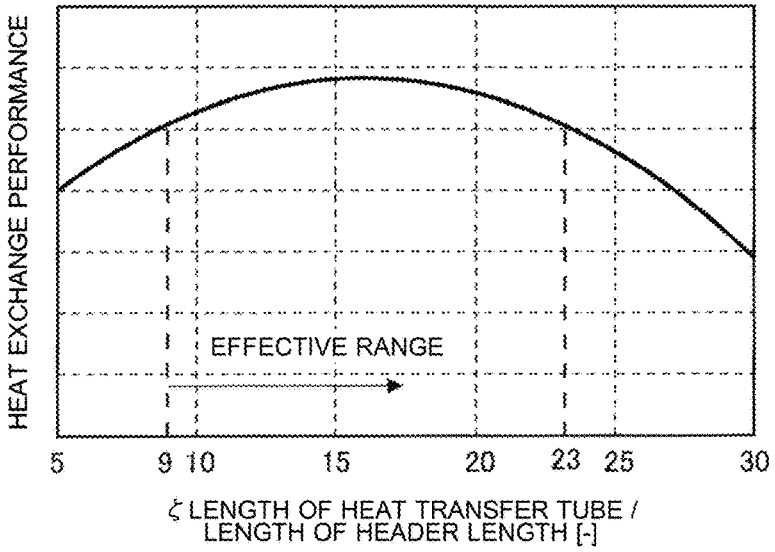
FIG. 6 is a performance evaluation graph indicating a relationship between a ratio ζ and a heat exchange performance according to Embodiment 1 of the present disclosure.
Figure 7:
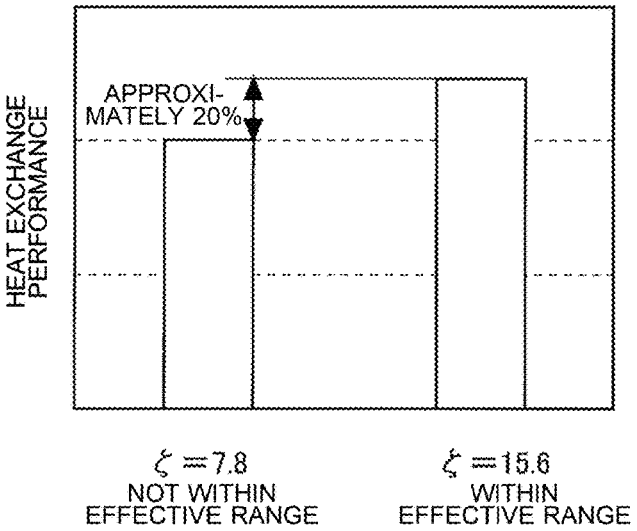
FIG. 7 is a performance evaluation graph indicating the relationship between a ratio ζ according to Embodiment 1 of the present disclosure and the heat exchange performance and a relationship between a ratio ζ that does not fall within a range and a heat exchange performance in the comparative example.
Figure 8:
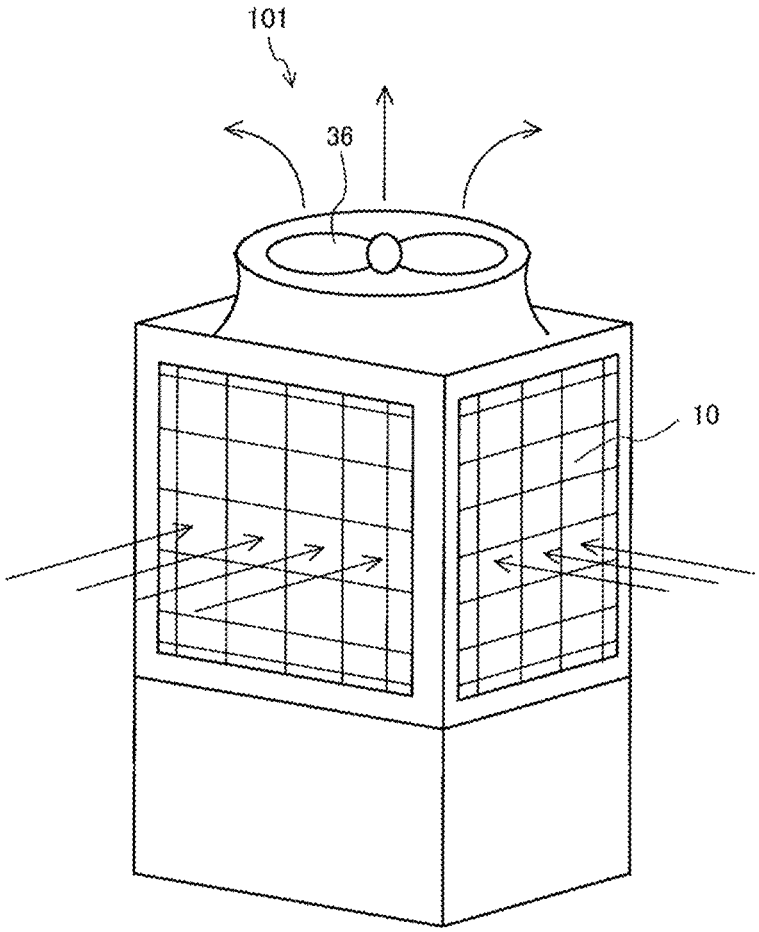
FIG. 8 is an explanatory view illustrating a configuration of an outdoor unit according to Embodiment 1 of the present disclosure.

FIG. 6 is a performance evaluation graph indicating a relationship between the ratio $\zeta$ and a heat exchange performance in Embodiment 1 of the present disclosure. FIG. 7 is a performance evaluation graph indicating a relationship between the ratio $\zeta$ in Embodiment 1 of the present disclosure and the heat exchange performance and a relationship between a ratio ζ that does not fall within a range and a heat exchange performance in the comparative example. FIG. 8 is an explanatory view illustrating a configuration of an outdoor unit 101 according to Embodiment 1 of the present disclosure.

FIG. 6 indicates an example of a relationship between the ratio ζ and the heat exchange performance that is established when the flow pattern of the refrigerant that flows into the liquid header distributor 12 is an annular flow or a churn flow, on the assumption that the outdoor unit 101 has a top-flow housing as schematically illustrated in FIG. 8. FIG. 7 illustrates a comparison between a heat exchange performance that is obtained when the ratio ζ is 7.8, which does not fall within an effective range indicated in FIG. 6 and a heat exchange performance that is obtained when the ratio ζ is 15.6, which falls within the effective range.

As indicated in FIG. 7, the heat exchange performance achieved when the ratio ζ is 15.6, which falls within the effective range, is improved by approximately 20% of that achieved when the ratio ζ is 7.8, which does not fall within the effective range. When the ratio ζ is 7.8, condensation droplets on the heat exchanger core 14 are frozen because of deterioration of the performance. In contrast, even at such a low flow rate as to cause formation of frost, when the ratio ζ is 15.6, the operation can be continuously performed without formation of frost on the heat exchanger core 14.

Therefore, when the ratio ζ is 15.6, the degree to which the performance is deteriorated is small even when the flow rate of refrigerant is low. Therefore, the heating operation can be continuously performed without formation of frost on the heat exchanger core 14. Therefore, the heating operation can be continuously performed in indoor space without stopping the operation, and it is not necessary to perform a defrosting operation. As a result, the operation efficiency can be increased.

The above improvement of the heat exchange performance is achieved because of improvement of the performance of distributing the refrigerant from the liquid header distributor 12 to the heat transfer tubes 11 and improvement of air velocity distribution. This will be described in detail below with reference to FIG. 11.

<Outdoor Unit 101 Including Outdoor Heat Exchanger 10>

Figure 9:
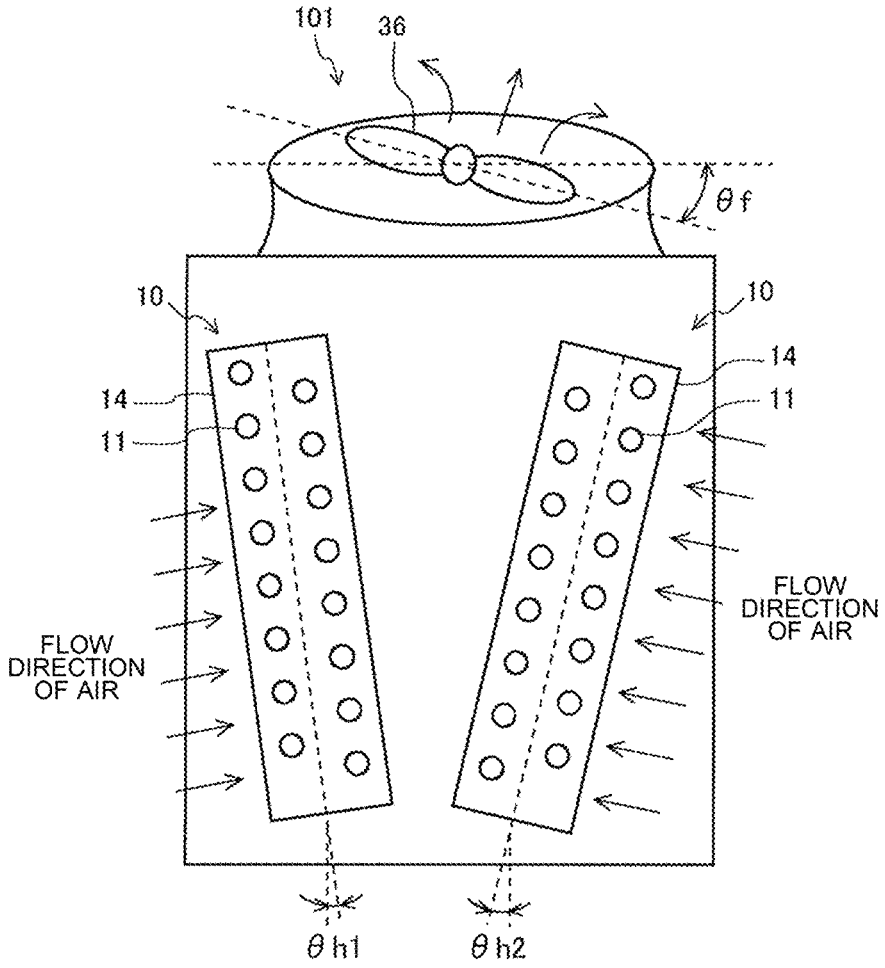
FIG. 9 is an explanatory view illustrating an internal configuration the internal structure of the outdoor unit according to Embodiment 1 of the present disclosure.
Figure 10:
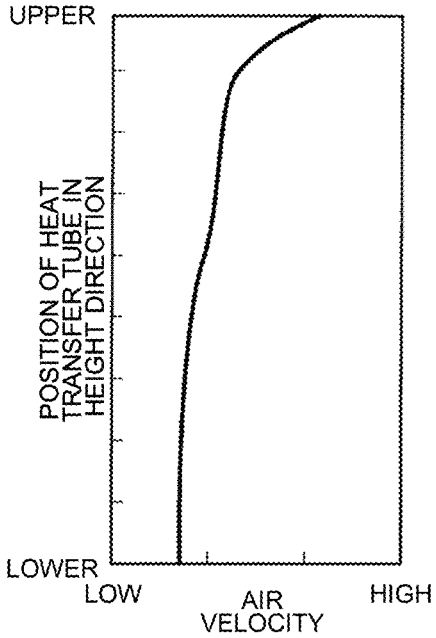
FIG. 10 is an explanatory view indicating a relationship between an air velocity and the position of the heat transfer tube in a height direction in the outdoor unit illustrated in FIG. 8 according to Embodiment 1 of the present disclosure.

FIG. 9 is an explanatory view illustrating an internal configuration of the outdoor unit 101 according to Embodiment 1 of the present disclosure. FIG. 10 is an explanatory view indicating a relationship between the air velocity and the position of the heat transfer tube 11 in a height direction in the outdoor unit 101 as illustrated in FIG. 8 in Embodiment 1 of the present disclosure.

As illustrated in FIG. 9, the outdoor fan 36 sends air in a direction along a rotational axis that extends in the vertical direction. The plane of rotation of the outdoor fan 36 is inclined at an angle θf of 45 degrees or less relative to a horizontal plane. The outdoor heat exchangers 10 are arranged such that directions orthogonal to the flows of air that passes through the outdoor heat exchanger 10 are inclined at angles θh1 and θh2 of 45 degrees or less relative to the vertical direction. In other words, the heat exchanger core 14 is provided to allow air to flow therethrough such that a component of the flow velocity of air in the horizontal direction is larger than a component of the air flow velocity in the vertical direction.

As indicated in FIG. 10, the air velocity distribution in the outdoor unit 101 having the top-flow housing as illustrated in FIG. 8 has such characteristics that the air velocity is high at the upper portion of the liquid header distributor 12, which is relatively close to the outdoor fan 36.

<Comparison Between Flow Rates of Refrigerant in Liquid Header Distributor 12 and Heat Transfer Tubes 11 Under Condition in Which Flow Rate of Refrigerant Is Low>

Figure 11:
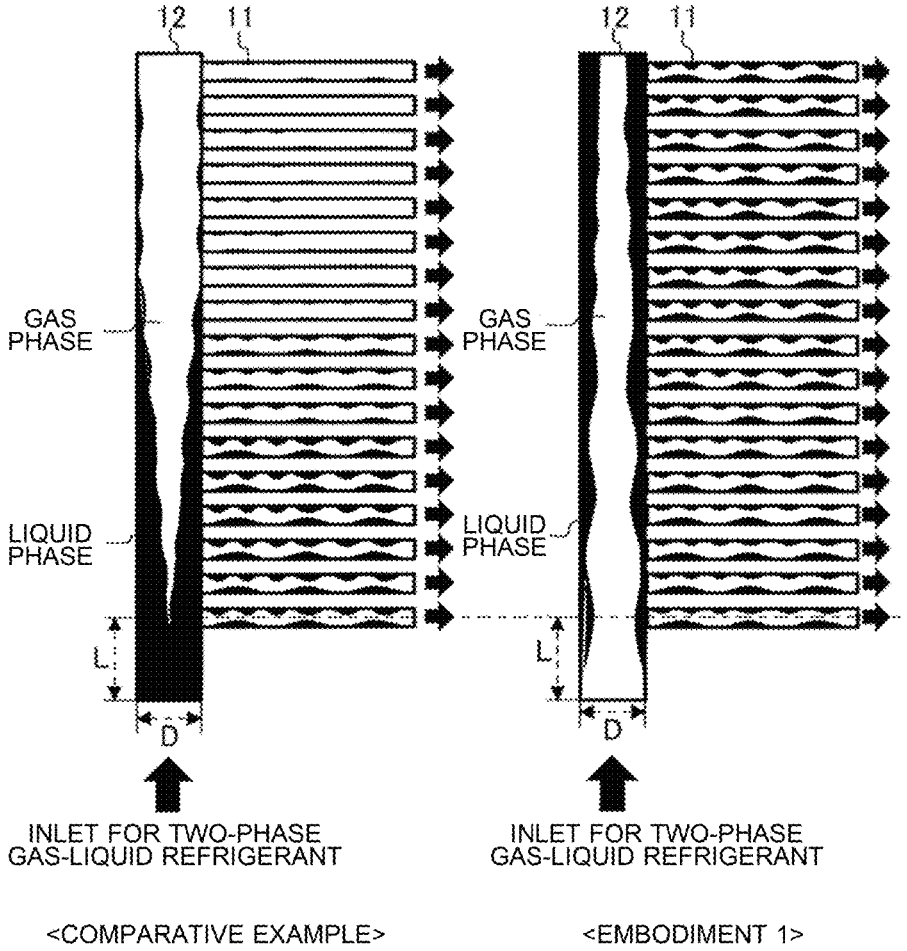
FIG. 11 is an explanatory view indicating a comparison between Embodiment 1 of the present disclosure and the comparative example regarding the flow rate of refrigerant in a liquid header distributor and the heat transfer tubes under a condition in which the flow rate of refrigerant is low.

FIG. 11 is an explanatory view illustrating a comparison between Embodiment 1 of the present disclosure and the comparative example regarding flow rates of refrigerant in the liquid header distributor 12 and the heat transfer tubes 11 under a condition in which the flow rate of refrigerant is low. The flow rates of the comparative example, which corresponds to the related art, are indicated on the left side of FIG. 11, and those of Embodiment 1 are indicated on the right side of FIG. 11.

In the comparative example, only a small amount of liquid refrigerant flows through the heat transfer tubes 11 connected to the upper portion of the liquid header distributor 12. Thus, refrigerant evaporates while flowing upward through the flow passage in the liquid header distributor 12, as a result of which the state of refrigerant changes from a two-phase state to a single-phase gas state. The heat exchange efficiency of the refrigerant being in the single-phase gas state is reduced, as compared with that of the refrigerant being in the two-phase state.

Furthermore, in the heat transfer tubes 11 connected to the lower portion of the liquid header distributor 12, a large amount of liquid refrigerant flows. Therefore, the flow passages in the heat transfer tubes 11 connected to the lower portion of the liquid header distributor 12 include regions for evaporation of two-phase gas-liquid refrigerant. However, the flow rate of air that flows outside the heat transfer tubes 11 connected to the lower portion of the liquid header distributor 12 is low. Thus, the heat exchange efficiency is also low at the lower portion of the liquid header distributor 12.

Thus, in the comparative example, the amount of heat exchange is small at both the heat transfer tubes 11 connected to the upper portion of the liquid header distributor 12 and the heat transfer tubes 11 connected to the lower portion of the liquid header distributor 12. Accordingly, the heat exchange efficiency of the entire outdoor heat exchanger 10 is reduced.

In contrast, in Embodiment 1, a large amount of liquid refrigerant also flows through the heat transfer tubes 11 connected to the upper portion of the liquid header distributor 12. As indicated in FIG. 10, at the upper portion of the liquid header distributor 12, the air velocity is high. Therefore, the heat exchange efficiency at the heat transfer tubes 11 is increased. Also, in the heat transfer tubes 11 connected to the lower portion of the liquid header distributor 12, heat exchange can be easily performed between air and refrigerant, as compared with the related art, even though the amount of the refrigerant is small, and the heat exchange efficiency is thus increased. Therefore, according to Embodiment 1, the heat exchange efficiency of the entire outdoor heat exchanger 10 is improved.

<Modification 1>

Figure 12:
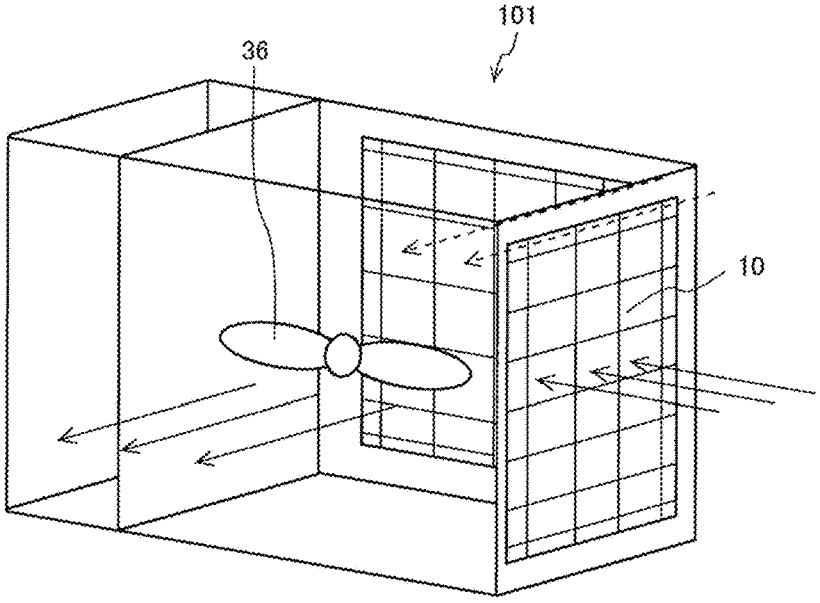
FIG. 12 is an explanatory view illustrating a configuration of an outdoor unit according to Modification 1 of Embodiment 1 of the present disclosure.
Figure 13:
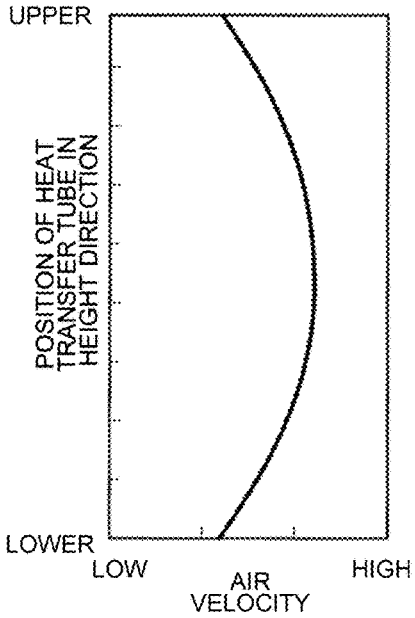
FIG. 13 is an explanatory view indicating a relationship between the air velocity and the position of the heat transfer tube in the height direction in the outdoor unit as illustrated in FIG. 12 according to Modification 1 of Embodiment 1 of the present disclosure.

FIG. 12 is an explanatory view illustrating a configuration of an outdoor unit 101 according to Modification 1 of Embodiment 1 of the present disclosure. FIG. 13 is an explanatory view indicating a relationship between the air velocity and the position of the heat transfer tube 11 in the height direction in the outdoor unit 101 as illustrated in FIG. 12 in Modification 1 of Embodiment 1 of the present disclosure. In Modification 1, descriptions of matters that are similar to those of Embodiment 1 will be omitted, and only features of Modification 1 will be described.

Regarding the outdoor unit 101 as illustrated in FIG. 12, a configuration example of a side-flow housing in which a single outdoor fan 36 is provided is illustrated. FIG. 13 indicates the air velocity distribution in the case where the outdoor unit 101 has the side-flow housing. As illustrated in FIG. 13, the air velocity distribution in the outdoor unit 101 having the side-flow housing has such characteristics that the air velocity is high at a central portion of the liquid header distributor 12 in the vertical direction, which is relatively close to the outdoor fan 36.

Also, in Modification 1, the refrigerant distribution characteristics are similar to those illustrated in FIG. 11. A refrigerant distributor of the related art has such refrigerant distribution characteristics as indicated on the left side of FIG. 1 that indicate those of the comparative example. Therefore, in the related art, the heat exchange efficiency is reduced at the central portion of the liquid header distributor 12, at which the air velocity is high. Also, at the lower portion of the liquid header distributor 12, at which the air velocity is low, a large amount of liquid refrigerant flows. Therefore, the heat exchange efficiency is reduced. Accordingly, the heat exchange efficiency of the entire outdoor heat exchanger 10 that is of a side flow type is reduced.

In contrast, the outdoor heat exchanger 10 of Modification 1 is similar to that of Embodiment 1. Therefore, the refrigerant distribution characteristics of Modification 1 are similar to those of Embodiment 1 that are indicated on the right side of FIG. 11. Accordingly, the heat exchange efficiency is improved at the central portion of the liquid header distributor 12, at which the air velocity is high. In addition, at the lower portion of the liquid header distributor 12, at which the air velocity is low, the flow rate of the liquid refrigerant is less than that in the comparative example in FIG. 11, and the heat exchange efficiency hardly decreases unnecessarily. Therefore, the heat exchange efficiency of the entire outdoor heat exchanger 10 is improved.

<Annular Flow Pattern and Churn Flow Pattern of Refrigerant>

Figure 14:
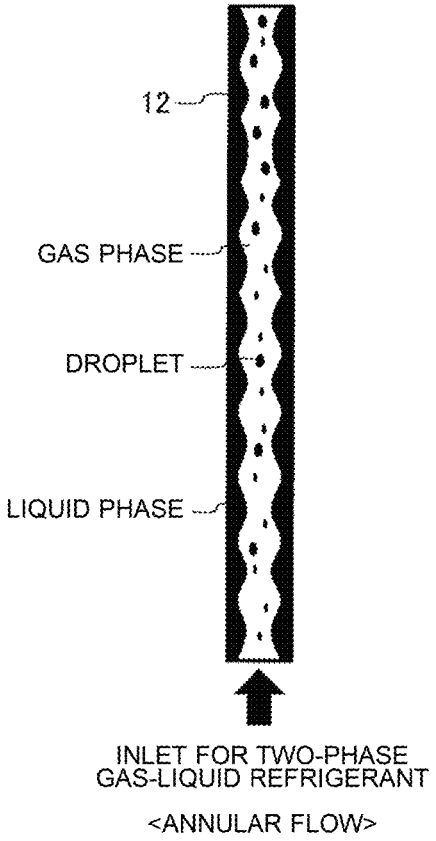
FIG. 14 is an explanatory view illustrating an annular flow pattern of refrigerant in a liquid header distributor according to Embodiment 1 of the present disclosure.
Figure 15:
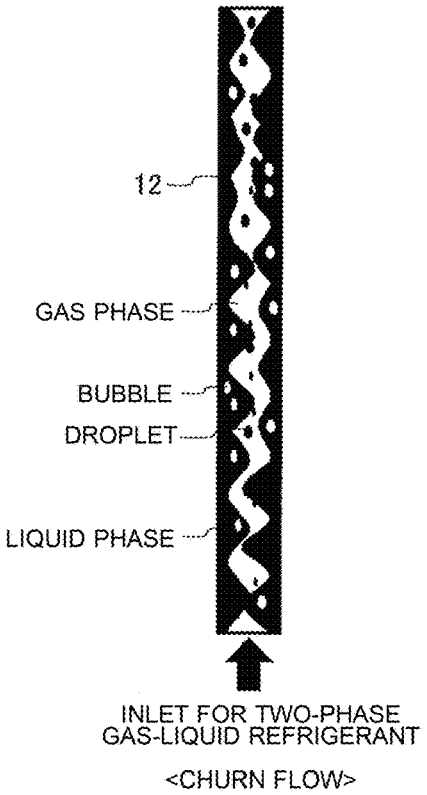
FIG. 15 is an explanatory view illustrating a churn flow pattern of refrigerant in the liquid header distributor according to Embodiment 1 of the present disclosure.

FIG. 14 is an explanatory view illustrating an annular flow pattern of the refrigerant in the liquid header distributor 12 according to Embodiment 1 of the present disclosure. FIG. 15 is an explanatory view illustrating a churn flow pattern of the refrigerant in the liquid header distributor 12 according to Embodiment 1 of the present disclosure.

As illustrated in FIGS. 14 and 15, the flow pattern of two-phase gas-liquid refrigerant that flows upward in the liquid header distributor 12 is an annular flow or a churn flow in which gas refrigerant flows through a central region of the liquid header distributor 12 and liquid refrigerant flows along an inner wall surface of the liquid header distributor 12.

FIG. 14 illustrates an annular flow in which gas refrigerant flows along with a large number of droplets through the central region of the liquid header distributor 12 and liquid refrigerant flows along the inner wall of the liquid header distributor 12. FIG. 15 illustrates a churn flow in which liquid refrigerant forms a liquid film having a thickness greater than that in an annular flow, and flows, with a large number of bubbles contained in the liquid film.

<Method of Setting Annular Flow Pattern and Churn Flow Pattern of Refrigerant>

The flow pattern of the refrigerant at the inlet of the liquid header distributor 12 is determined from a flow pattern diagram of a vertically upward flow, and is set based on a reference apparent gas velocity UGS [m/s] of the refrigerant at a maximum value in a variation range of the flow velocity of the refrigerant at the inlet of the liquid header distributor 12. Two examples of the setting method will be described.

In a first example, a is a void fraction of the refrigerant, L [m] is an entrance length at an inlet portion of the liquid header distributor, g [$m/s^2$] is the gravitational acceleration, and D [m] is an inside diameter of the liquid header distributor 12. The void fraction $\alpha$ of the refrigerant is expressed by $\alpha=x/(x+(\rho G/\rho L)\times(1-x))$, where x [–] is the quality of the refrigerant, $\rho G$ [$kg/m^3$] is a gas refrigerant density, and $\rho L$ [$kg/m^3$] is a liquid refrigerant density. The reference apparent gas velocity UGS [m/s], which is the maximum value in the variation range of the apparent gas velocity of the refrigerant that flows into the liquid header distributor 12, satisfies $UGS \geq \alpha\times L\times(g\times D)^{0.5}/(40.6\times D)-0.22\times\alpha\times(g\times D)^{0.5}$. In the first example, the flow pattern is a churn flow.

In a second example, $\rho G$ [$kg/m^3$] is the gas refrigerant density, $\rho L$ [$kg/m^3$] is the liquid refrigerant density, and $\sigma$ [N/m] is a surface tension of the refrigerant. The reference apparent gas velocity UGS [m/s], which is the maximum value in the variation range of the apparent gas velocity of the refrigerant that flows into the liquid header distributor 12, satisfies $UGS \geq 3.1/(\rho G^{0.5})\times[\sigma\times g\times(\rho L-\rho G)]^{0.25}$. In the second example, the flow pattern is an annular flow.

The entrance length L [m] at the inlet portion of the liquid header distributor 12 corresponds to the distance between the inlet portion of the liquid header distributor 12 and the central axis of one of the heat transfer tubes 11 that is the closest to the inlet portion.

<Other Examples of Embodiment 1>

Preferably, the ratio $\zeta$ of the length of the heat transfer tubes 11 to the length of the liquid header distributor 12 should satisfy $9 \leq \zeta \leq 23$. More preferably, the ratio $\zeta$ should satisfy $13 \leq \zeta \leq 20$. These ranges are preferable because, as is clear from FIG. 6, the heat exchange performance is achieved such that $\zeta$ varies to be curved as an upward convex as indicated in the figure.

As described above, in Embodiment 1, $\zeta$ is set to a relatively large value. However, as in the configuration example as illustrated in FIG. 3, the flow passages of the heat transfer tubes 11 include the U-shaped bent portions 16 that are bent in directions other than the horizontal direction. Accordingly, the length of the heat exchanger core 14 can be reduced, and the outdoor heat exchanger 10 can be made small in size.

The flow resistance in each heat transfer tube 11 including the U-shaped bent portions 16 is increased, as compared with the case where the heat transfer tube 11 is a straight tube. Therefore, in the case where long heat transfer tubes 11 are used, an advantage similar to that obtained by increasing $\zeta$ can be obtained by increasing the number of U-shaped bent portions 16 or reducing the curvature of each of the U-shaped bent portions 16. Accordingly, in the case where each heat transfer tube 11 includes two or more U-shaped bent portions 16 as in the configuration example as illustrated in FIG. 3, the distribution performance can be further improved.

On the assumption that the size of the heat exchanger core 14 remains unchanged, as the number of U-shaped bent portions 16 is increased, the number of heat transfer tubes 11 connected to the liquid header distributor 12 and the gas header distributor 13 is reduced, and the distribution performance is improved.

The U-shaped bent portions 16 may be bent downward at the lower portion of the liquid header distributor 12 and may be bent upward at the upper portion of the liquid header distributor 12. In such a case, the lengths of the heat transfer tubes 11 connected to the upper portion and the lower portion of the liquid header distributor 12 are less than in the case where all of the U-shaped bent portions 16 are bent upward. Therefore, the balance between pressure losses due to gravity between the passages that extend through the heat transfer tubes 11 connected to the upper portion of the liquid header distributor 12 and the passages that extend through the heat transfer tubes 11 connected to the lower portion of the liquid header distributor 12 can be improved. That is, the differences in pressure loss between the passages can be relatively reduced. As a result, the refrigerant distribution performance can be improved, and the heat exchange performance can be improved.

<Advantages of Embodiment 1>

According to Embodiment 1, the outdoor heat exchanger 10 includes the heat transfer tubes 11. The outdoor heat exchanger 10 also includes the liquid header distributor 12 to which one end of each of the heat transfer tubes 11 is connected and in which an upward flow of two-phase gas-liquid refrigerant is generated. The outdoor heat exchanger 10 also includes the gas header distributor 13 to which the other end of each of the heat transfer tubes 11 is connected and in which a flow of gas phase refrigerant is generated. Each of the heat transfer tubes 11 includes U-shaped bent portions 16 at each of which the flow passage is bent in directions other than a horizontal direction. Where Lh [m] is the length of the liquid header distributor 12, Lb [m] is the length of the shortest one of the heat transfer tubes 11, and ζ is the ratio of the length Lb of the shortest one of the heat transfer tubes 11 to the length Lh of the liquid header distributor 12, and is expressed by ζ=Lb/Lh, the relationship between the liquid header distributor 12 and the heat transfer tubes 11 is established such that 9≤ζ is satisfied. The length Lh of the liquid header distributor 12 corresponds to the distance between the central axis of one of the heat transfer tubes 11 that is the closest to the inlet of the liquid header distributor 12 and the central axis of one of the heat transfer tubes 11 that is the farthest from the inlet of the liquid header distributor 12. The length Lb of the shortest heat transfer tube 11 corresponds to a distance by which the shortest heat transfer tube 11, which extends from the liquid header distributor 12 to the gas header distributor 13 through the heat exchanger core 14 and the U-shaped bent portions 16, extends through the heat exchanger core 14 (Lb=Lb1+Lb2+Lb3).

In the above configuration, the ratio of the flow resistance in the liquid header distributor 12 to the flow resistance in the heat transfer tubes 11 is sufficiently small. Thus, the influence of the flow resistance in the liquid header distributor 12 on the distribution of the refrigerant can be reduced. Therefore, an adverse effect on the refrigerant distribution characteristics that is caused when the flow rate of refrigerant varies can be reduced, and deterioration of the heat exchange performance can thus be reduced. As a result, it is not necessary to change the specifications of the outdoor heat exchanger 10 each time the flow rate or the kind of the refrigerant that is used is changed.

In Embodiment 1, the relationship between the liquid header distributor 12 and the heat transfer tubes 11 is established such that 9≤ζ≤23 is satisfied.

In the above configuration, the ratio of the flow resistance in the liquid header distributor 12 to the flow resistance in the heat transfer tubes 11 is more suitably reduced. Therefore, the influence of the flow resistance in the liquid header distributor 12 on the distribution of the refrigerant can be further reduced. Accordingly, an adverse effect on the refrigerant distribution characteristics that is caused when the flow rate of the refrigerant varies can be further reduced, and deterioration of the heat exchange performance can be thus further reduced.

In Embodiment 1, the outdoor heat exchanger 10 includes the heat exchanger core 14 that includes the heat transfer tubes 11 and one or more fins. The U-shaped bent portions 16 are located outside the heat exchanger core 14. The length Lb of the shortest heat transfer tube 11 corresponds to the distance by which the shortest heat transfer tube 11, which extends from the liquid header distributor 12 to the gas header distributor 13 through the heat exchanger core 14 and the U-shaped bent portions 16, extends through the heat exchanger core 14.

In the above configuration, where the ratio ζ of the length Lb of the shortest heat transfer tube 11 to the length Lh of the liquid header distributor 12 is expressed by ζ=Lb/Lh, 9≤ζ can be easily satisfied.

In Embodiment 1, in the heat exchanger core 14, at least one of the heat transfer tubes 11 that is located from the intermediate portion to the upper portion of the liquid header distributor 12 includes a larger number of U-shaped bent portions 16 than at least one of the heat transfer tubes 11 that is located at the lower portion of the liquid header distributor 12.

In the above configuration, the heat exchange efficiency of a region in which the air velocity is high and which is located from the intermediate portion to the upper portion of the liquid header distributor 12 is improved. In addition, at the lower portion of the liquid header distributor 12, in which the air velocity is low, the flow rate of the liquid refrigerant is reduced, and the heat exchange efficiency is not easily reduced. Therefore, the heat exchange efficiency of the entire outdoor heat exchanger 10 is improved.

In Embodiment 1, the flow pattern of refrigerant that flows in a two-phase gas-liquid state and upward through the liquid header distributor 12 is an annular flow or a churn flow in which gas refrigerant flows through the central region of the liquid header distributor 12 and liquid refrigerant flows along the inner wall surface of the liquid header distributor 12.

In the above configuration, when the flow pattern is the annular flow, gas refrigerant flows along with a large number of droplets through the central region of the liquid header distributor 12 and liquid refrigerant flows along the inner wall of the liquid header distributor 12. When the flow pattern is the churn flow, the liquid refrigerant forms a liquid film having a thickness greater than that in the annular flow and flows while containing a large number of bubbles.

Regarding Embodiment 1, it should be noted that α is the void fraction of the refrigerant, L [m] is the entrance length at the inlet portion of the liquid header distributor 12, g [$m/s^2$] is the gravitational acceleration, and D [m] is the inside diameter of the liquid header distributor 12. Also, where x [−] is the quality of the refrigerant, ρG [$kg/m^3$] is the gas refrigerant density, and ρL [$kg/m^3$] is the liquid refrigerant density, the void fraction α of the refrigerant is expressed by $\alpha=x/(x+(\rho G/\rho L)\times(1-x))$. The reference apparent gas velocity UGS [m/s], which is the maximum value in the variation range of the apparent gas velocity of the refrigerant that flows into the liquid header distributor 12, satisfies $UGS \geq \alpha\times L\times(g\times D)^{0.5}/(40.6\times D)-0.22\times\alpha\times(g\times D)^{0.5}$.

In the above configuration, the flow pattern of the refrigerant that flows in a two-phase gas-liquid state and upward through the liquid header distributor 12 with respect to a direction orthogonal to the flow direction is a churn flow in which gas refrigerant flows through the central region of the liquid header distributor 12 and liquid refrigerant flows along the inner wall surface of the liquid header distributor 12.

According to Embodiment 1, where $\rho G$ [kg/m$^3$] is the gas refrigerant density, $\rho L$ [kg/m$^3$] is the liquid refrigerant density, and $\sigma$ [N/m] is the surface tension of the refrigerant, the reference apparent gas velocity UGS [m/s], which is the maximum value in the variation range of the apparent gas velocity of the refrigerant that flows into the liquid header distributor 12, satisfies $UGS \geq 3.1/(\rho G^{0.5}) \times [\sigma \times g \times (\rho L - \rho G)]^{0.25}$.

In the above configuration, the flow pattern of the refrigerant that flows in a two-phase gas-liquid state and upward through the liquid header distributor 12 on a plane orthogonal to the flow direction is an annular flow in which gas refrigerant flows through the central region of the liquid header distributor 12 and liquid refrigerant flows along the inner wall surface of the liquid header distributor 12.

In Embodiment 1, the heat exchanger core 14 is provided to allow air to flow therethrough such that a component of the flow velocity of air in the horizontal direction is larger than a component of the air flow velocity of air in the vertical direction. The outdoor heat exchanger 10 includes the outdoor fan 36 that sends air in a direction along the rotational axis and that is located such that a rotational plane of the outdoor fan 36 is inclined at an angle of 45 degrees or less relative to a horizontal plane.

In the above configuration, the ratio of the flow resistance in the liquid header distributor 12 to the flow resistance in the heat transfer tubes 11 is sufficiently small. Thus, the influence of the flow resistance in the liquid header distributor 12 on the distribution of the refrigerant can be reduced. Therefore, an adverse effect on the refrigerant distribution characteristics that is caused when the flow rate of refrigerant varies can be reduced, and deterioration of the heat exchange performance can thus be reduced.

In Embodiment 1, the liquid header distributor 12 is provided at a lower position than the gas header distributor 13.

In the above configuration, refrigerant that flows in the liquid header distributor 12 is in a single-phase liquid state or a two-phase gas-liquid state and has a higher density than refrigerant that flows through the gas header distributor 13. Therefore, in the case where the gas header distributor 13 is provided at a higher position than the liquid header distributor 12, a pressure loss due to gravity in the liquid header distributor 12 and the gas header distributor 13 can be reduced.

In Embodiment 1, the air-conditioning apparatus 100 includes the above outdoor heat exchanger 10.

In the above configuration, in the air-conditioning apparatus 100 that includes the outdoor heat exchanger 10, it is not necessary to change the specifications of the heat exchanger each time the flow rate or the type of the refrigerant that is used is changed.

Embodiment 2

Figure 16:
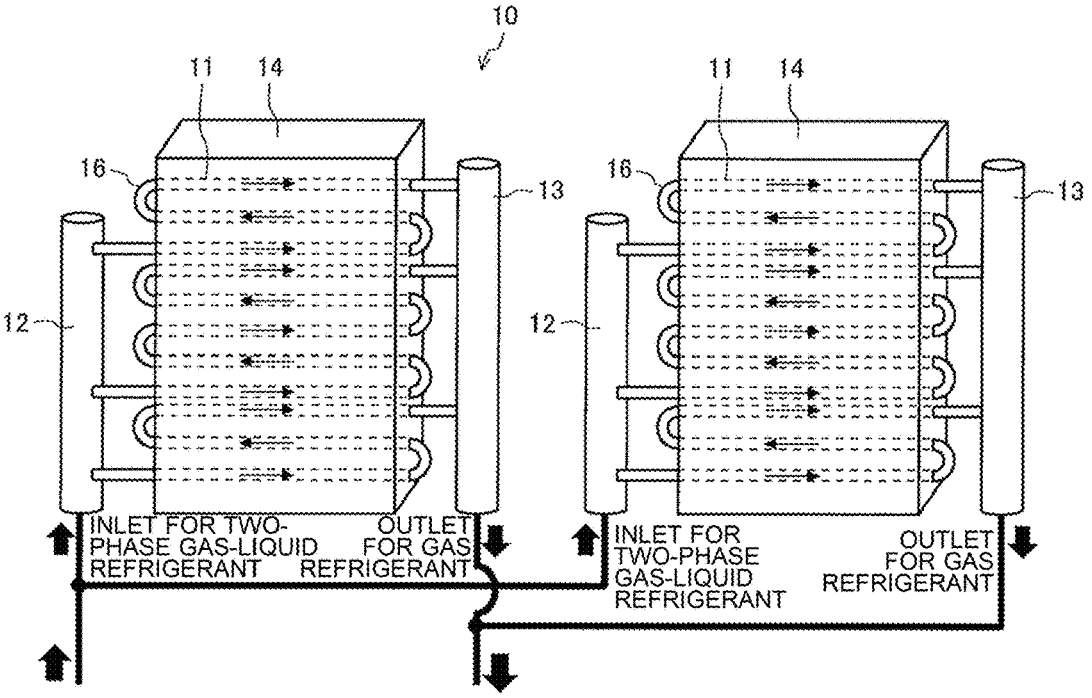
FIG. 16 is an explanatory view illustrating a configuration of an outdoor heat exchanger according to Embodiment 2 of the present disclosure.
Figure 17:
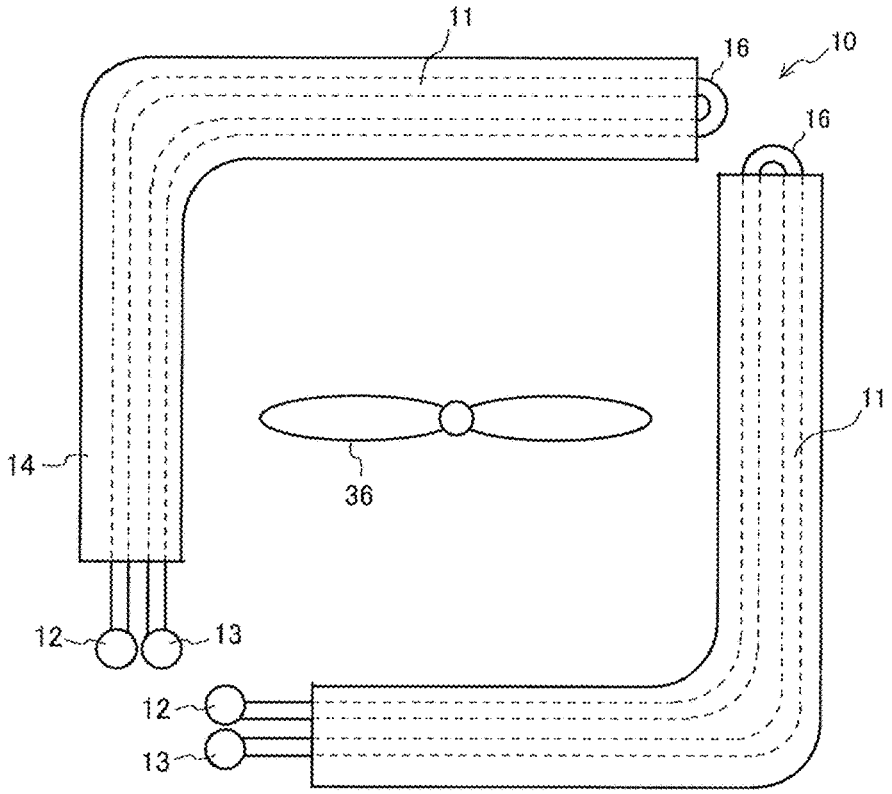
FIG. 17 is a top view illustrating the configuration of the outdoor heat exchanger according to Embodiment 2 of the present disclosure.

FIG. 16 is an explanatory view illustrating a configuration of an outdoor heat exchanger 10 according to Embodiment 2 of the present disclosure. FIG. 17 is a top view illustrating the configuration of the outdoor heat exchanger 10 according to Embodiment 2 of the present disclosure. Regarding Embodiment 2, descriptions of matters that are similar to those of any of Embodiment 1, Modification 1, and other examples will be omitted, and only features of Embodiment 2 will be described.

As illustrated in FIGS. 16 and 17, the outdoor heat exchanger 10 is divided into two each of which includes a plurality of heat transfer tubes 11, a liquid header distributor 12, a gas header distributor 13, and a heat exchanger core 14. FIG. 17 illustrates by way of example the case where the heat transfer tubes 11 are arranged in two rows. However, the number of rows of the heat transfer tubes 11 is not limited to two, and may be one or three or more.

Referring to FIG. 17, the two separate heat exchanger cores 14 are L-shaped. However, each of the two separate heat exchanger cores 14 may be bent two or more times to have a U-shape or a rectangular shape, or may be formed in the shape of an elongated plate without being bent, depending on the shape of a housing.

Since the outdoor heat exchanger 10 is divided into two sections and thus includes two heat exchanger cores 14, the outdoor heat exchanger 10 can thus obtain a higher heat exchange performance. In addition, in the case where the rotational axis of the outdoor fan 36 extends in the vertical direction, the flow rate of the refrigerant that flows through the heat transfer tubes 11 at the upper portion of the outdoor heat exchanger 10, at which the air velocity is high, is improved. Therefore, the heat exchange performance can be further improved.

<Modification 2>

Figure 18:
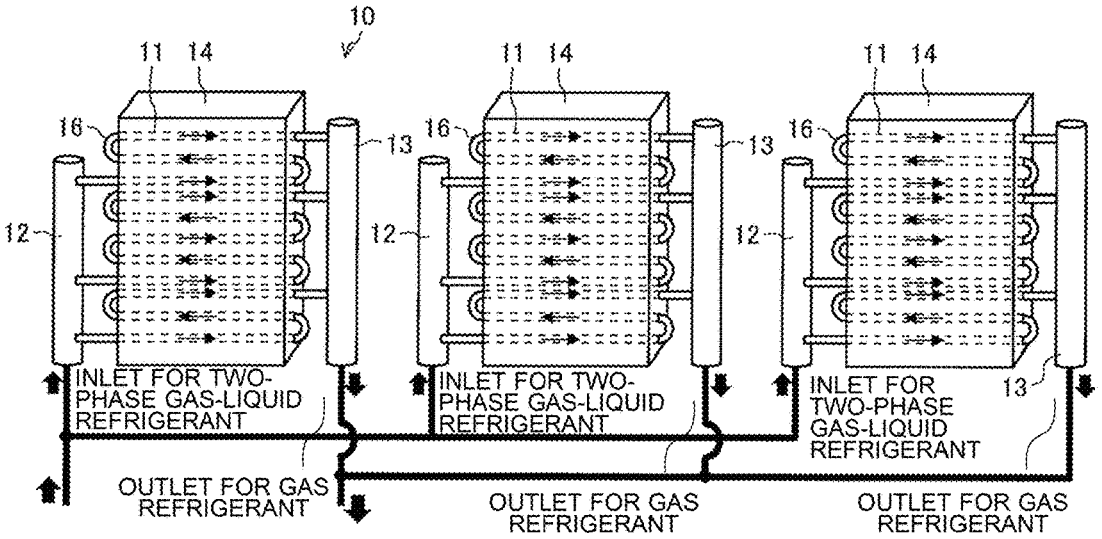
FIG. 18 is an explanatory view illustrating a configuration of an outdoor heat exchanger according to Modification 2 of Embodiment 2 of the present disclosure.
Figure 19:
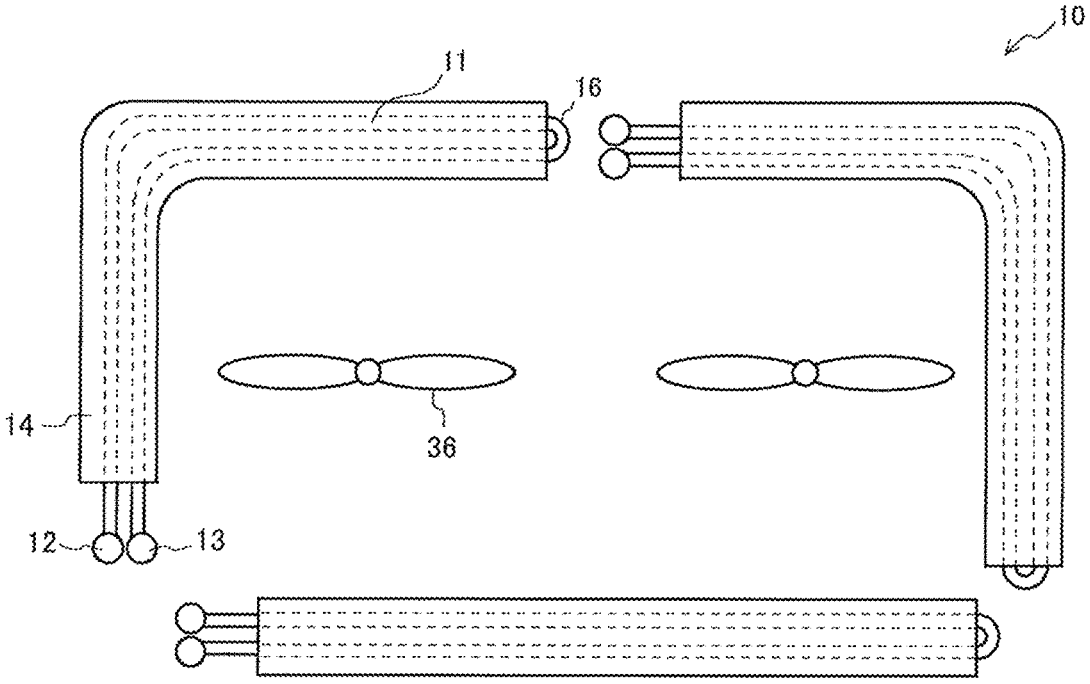
FIG. 19 is a top view illustrating the configuration of the outdoor heat exchanger according to Modification 2 of Embodiment 2 of the present disclosure.

FIG. 18 is an explanatory view illustrating a configuration of an outdoor heat exchanger 10 according to Modification 2 of Embodiment 2 of the present disclosure. FIG. 19 is a top view illustrating the configuration of the outdoor heat exchanger 10 according to Modification 2 of Embodiment 2 of the present disclosure. Regarding Modification 2, descriptions of matters that are similar to those of any of Embodiment 1, Modification 1, other examples, and Embodiment 2 will be omitted, and only features of Modification 2 will be described.

As illustrated in FIGS. 18 and 19, the outdoor heat exchanger 10 is divided into three sections, and each of the sections includes a plurality of heat transfer tubes 11, a liquid header distributor 12, a gas header distributor 13, and a heat exchanger core 14. FIG. 19 illustrates by way of example the case where the heat transfer tubes 11 are provided in two rows. However, the number of rows of the heat transfer tubes 11 is not limited to two, and may be one or three or more. The outdoor heat exchanger 10 may be divided into four or more sections.

FIG. 19 illustrates an example in which two outdoor fans 36 are provided. However, the number of outdoor fans 36 is not limited to two, and may be one or three or more.

In the case where the outdoor heat exchanger 10 is divided into three or more sections, the outdoor heat exchanger 10 can obtain a higher heat exchange performance. In addition, in the case where the rotational axis of each outdoor fan 36 extends in the vertical direction, the flow rate of the refrigerant that flows through the heat transfer tubes 11 at the upper portion of the outdoor heat exchanger 10, at which the air velocity is high, is increased. Therefore, the heat exchange performance can be further improved.

<Advantages of Embodiment 2>

In Embodiment 2, the outdoor heat exchanger 10 is divided into two or more sections. Each of the sections includes heat transfer tubes 11, a liquid header distributor 12, and a gas header distributor 13.

In the above configuration, since the outdoor heat exchanger 10 is divided into two or more sections, a higher heat exchange performance can be obtained.

Embodiment 3

Figure 20:
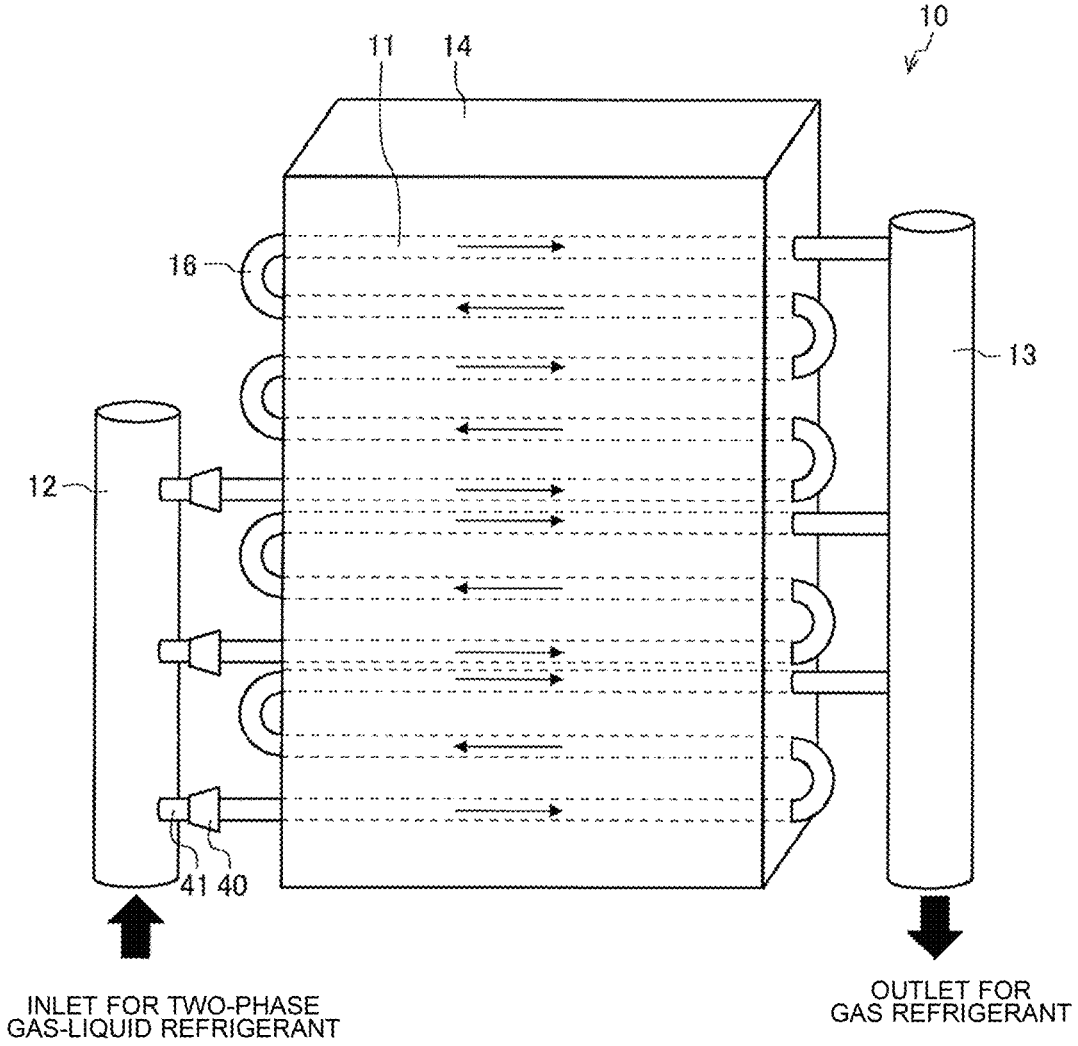
FIG. 20 is an explanatory view illustrating a configuration of an outdoor heat exchanger according to Embodiment 3 of the present disclosure.

FIG. 20 is an explanation view illustrating a configuration of an outdoor heat exchanger 10 according to Embodiment 3 of the present disclosure. Regarding Embodiment 3, descriptions of matters that are similar to those of any of Embodiment 1, Modification 1, other examples, Embodiment 2, and Modification 2 will be omitted, and only features of Embodiment 3 will be described.

As illustrated in FIG. 20, the outdoor heat exchanger 10 includes a plurality of branch tubes 41 connected to the liquid header distributor 12 and tube-shaped conversion joints 40 connected between the branch tubes 41 and the heat transfer tubes 11.

When the flow rate of refrigerant is low, the tube-shaped conversion joints 40 serve to adjust the balance of flow resistance between the liquid header distributor 12 and the heat transfer tubes 11. Thus, the adverse effect on the distribution of the refrigerant can be reduced, and the deterioration of the heat exchange performance can thus be reduced.

It is illustrated by way of example that the tube-shaped conversion joints 40 are connected to all of the branch tubes 41 and the heat transfer tubes 11 connected to the liquid header distributor 12. However, the tube-shaped conversion joints may be connected to heat transfer tubes 11 connected to the gas header distributor 13. Also, the tube-shaped conversion joints may be connected to some of the heat transfer tubes 11. In this case, in the case where the tube-shaped conversion joints are connected to some of the heat transfer tubes 11 at which the flow rate of refrigerant is relatively high, the pressure loss can be more greatly reduced.

<Advantages of Embodiment 3>

In Embodiment 3, in the outdoor heat exchanger 10, at least one or more of the heat transfer tubes 11 are connected to the liquid header distributor 12 or the gas header distributor 13 through the tube-shaped conversion joints 40.

In the above configuration, when the flow rate of refrigerant is low, the tube-shaped conversion joints 40 serve to adjust the balance of flow resistance between the liquid header distributor 12 and the heat transfer tubes 11. Thus, the adverse effect on the distribution of the refrigerant can be reduced, and the deterioration of the heat exchange performance can thus be reduced.

Embodiment 4

Figure 21:
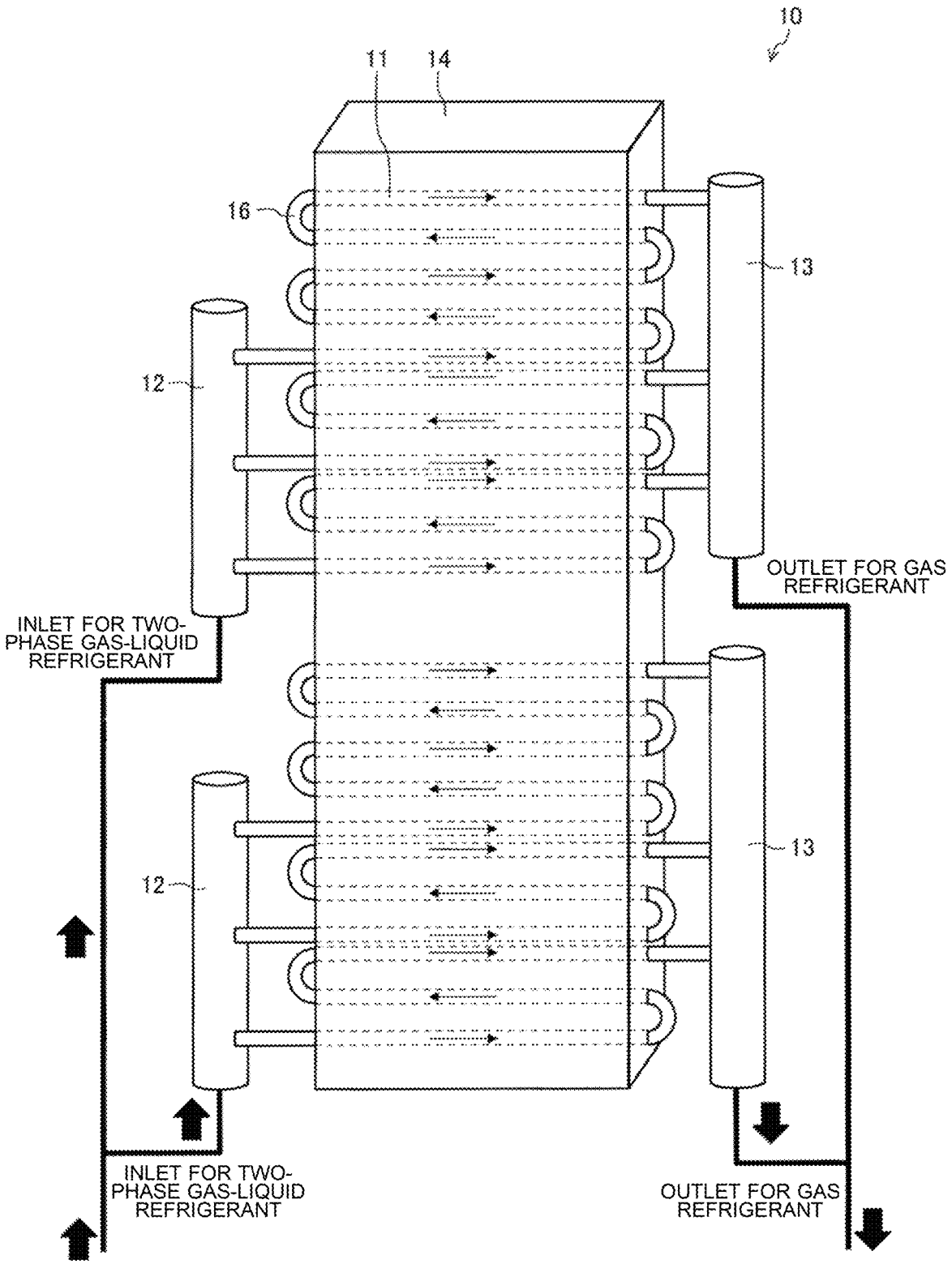
FIG. 21 is an explanatory view illustrating a configuration of an outdoor heat exchanger according to Embodiment 4 of the present disclosure.

FIG. 21 is an explanatory view illustrating a configuration of an outdoor heat exchanger 10 according to Embodiment 4 of the present disclosure. Regarding Embodiment 4, descriptions of matters that are similar to those of any of Embodiment 1, Modification 1, other examples, Embodiment 2, Modification 2, and Embodiment 3 will be omitted, and only features of Embodiment 4 will be described.

As illustrated in FIG. 21, the liquid header distributor 12 and the gas header distributor 13 of the outdoor heat exchanger 10 are each divided into two sections. Each of the sections are connected to heat transfer tubes 11. FIG. 21 illustrates an example in which the liquid header distributor 12 and the gas header distributor 13 are each divided into two in a longitudinal direction of each of the liquid header distributor 12 and the gas header distributor 13, which is the flow direction of refrigerant. However, it is not indispensable that each of the liquid header distributor 12 and the gas header distributor 13 is divided to two. That is, each of the liquid header distributor 12 and the gas header distributor 13 may be divided into three or more. Alternatively, only one of the liquid header distributor 12 and the gas header distributor 13 may be divided into two or more sections.

In the above configuration, when the outdoor heat exchanger 10 operates as an evaporator, refrigerant flows in a two-phase gas-liquid state into each of the two sections into which the liquid header distributor 12 is divided. The refrigerant that has flowed into each of the two sections of the liquid header distributor 12 passes through the heat transfer tubes 11 connected to the two sections of the liquid header distributor 12 and then through the gas header distributor 13, and flows out of the outdoor heat exchanger 10.

When the flow rate of refrigerant is low, the influence of the pressure loss in the liquid header distributor 12 may be greater than the influence of the pressure loss in the heat transfer tubes 11, and the distribution of the refrigerant may be adversely affected. However, in Embodiment 4 as described with reference to FIG. 21, the liquid header distributor 12 is divided, whereby the influence of the pressure loss in the liquid header distributor 12 is reduced. Thus, the adverse effect on the distribution of the refrigerant can be reduced, and the deterioration of the heat exchange performance can thus be reduced.

Figure 22:
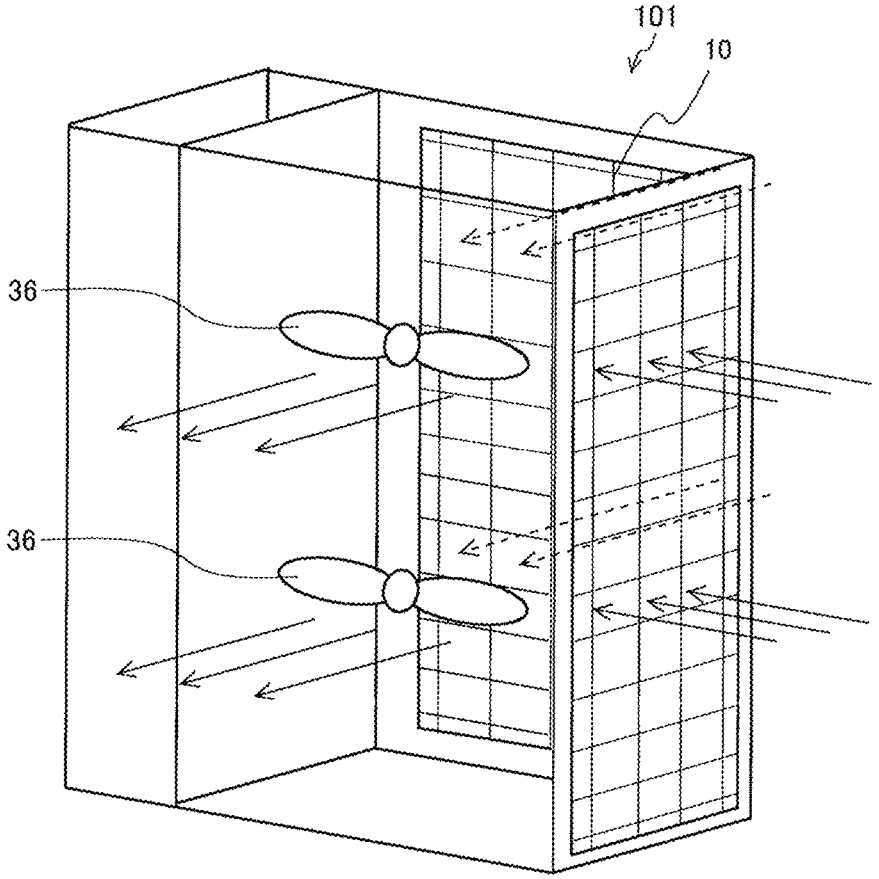
FIG. 22 is an explanatory view illustrating a configuration of an outdoor unit according to Embodiment 4 of the present disclosure.
Figure 23:
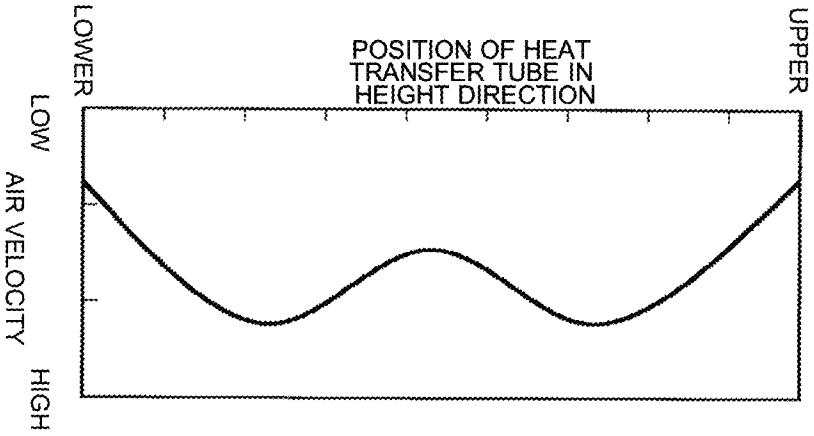
FIG. 23 is an explanatory view indicating a relationship between the air velocity and the of the heat transfer tube in the height direction in the outdoor unit as illustrated in FIG. 22 according to Embodiment 4 of the present disclosure.

FIG. 22 is an explanatory view illustrating a configuration of an outdoor unit 101 according to Embodiment 4 of the present disclosure. FIG. 23 is an explanatory view indicating a relationship between the air velocity and the position of the heat transfer tubes 11 in the height direction in the outdoor unit 101 as illustrated in FIG. 22 according to Embodiment 4 of the present disclosure.

In the case where two outdoor fans 36 are provided as illustrated in FIG. 22, the air velocity is distributed as illustrated in FIG. 23, whereby the heat exchange efficiency can be improved in each of the sections into which the liquid header distributor 12 is divided. Accordingly, the heat exchange performance of the entire outdoor heat exchanger 10 can be improved.

<Advantages of Embodiment 4>

According to Embodiment 4, both or either one of the liquid header distributor 12 and the gas header distributor 13 is divided into two or more sections.

In the above configuration, the liquid header distributor 12 and/or the gas header distributor 13 is divided, whereby the influence of the pressure loss in the liquid header distributor 12 or the gas header distributor 13 is reduced. Thus, the adverse effect on the distribution of the refrigerant can be reduced, and the deterioration of the heat exchange performance can thus be reduced.

Embodiment 5

Figure 24:
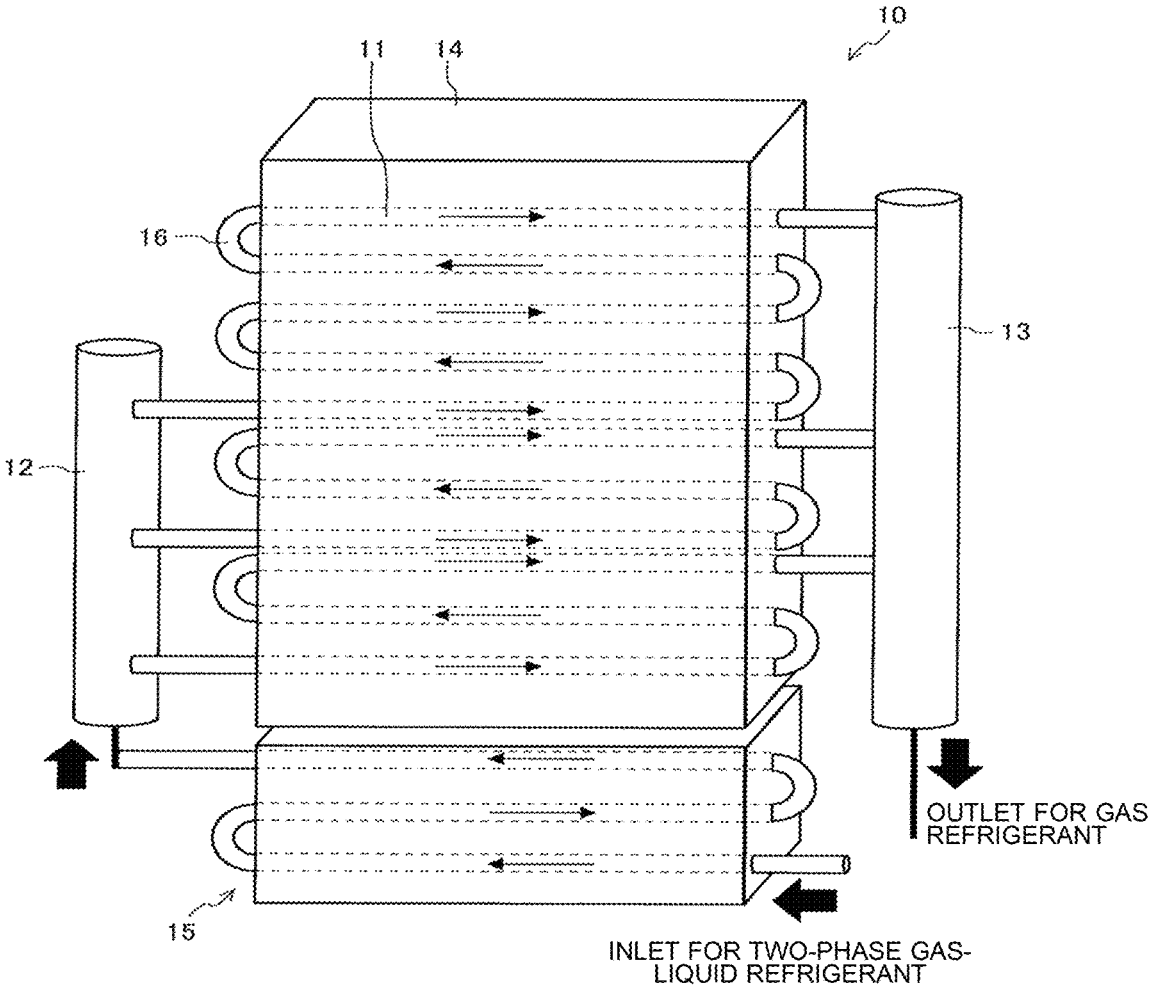
FIG. 24 is an explanatory view illustrating a configuration of an outdoor heat exchanger according to Embodiment 5 of the present disclosure.

FIG. 24 is an explanatory view illustrating a configuration of an outdoor heat exchanger 10 according to Embodiment 5 of the present disclosure. Regarding Embodiment 5, descriptions of matters that are similar to those of any of Embodiment 1, Modification 1, other examples, Embodiment 2, Modification 2, Embodiment 3, and Embodiment 4 will be omitted, and only features of Embodiment 5 will be described.

As illustrated in FIG. 24, a subcooling heat exchanger 15 is provided upstream of the outdoor heat exchanger 10 in a direction in which the refrigerant flows when the outdoor heat exchanger 10 operates as an evaporator. FIG. 24 illustrates by way of example the case where in which the subcooling heat exchanger 15 is provided below the heat exchanger core 14. However, the subcooling heat exchanger 15 may be provided above the heat exchanger core 14 or on the left or right of the heat exchanger core 14. In particular, in the case where the subcooling heat exchanger 15 is provided at a position at which the air velocity is high, the heat exchange efficiency can be improved. The subcooling heat exchanger 15, as well as the heat exchanger core 14, includes heat transfer tubes and fins.

In the above configuration, in the case where the outdoor heat exchanger 10 operates as an evaporator, first, refrigerant flows in a two-phase gas-liquid state into the subcooling heat exchanger 15. Then, the refrigerant exchanges heat with air such that the quality thereof is increased, and then flows out of the subcooling heat exchanger 15. The refrigerant that has flowed out of the subcooling heat exchanger 15 flows into the liquid header distributor 12. Then, the refrigerant exchanges heat with air to change into a single-phase gas refrigerant, and flows out of the gas header distributor 13.

In the above case, the quality of the two-phase gas-liquid refrigerant that flows into the liquid header distributor 12 is raised higher than in the case where the subcooling heat exchanger 15 is not provided. Therefore, the flow velocity of the gas phase refrigerant is increased, and as a result the flow velocity of the liquid phase refrigerant is also increased. Accordingly, the flow resistance in the liquid header distributor 12 is reduced, as compared with the flow resistance in the heat transfer tubes 11. As a result, the ratio of the flow resistance in the liquid header distributor 12 to the flow resistance in the heat transfer tubes 11 is small. Thus, the influence of the flow resistance in the liquid header distributor 12 on the distribution of the refrigerant can be reduced. Therefore, an adverse effect on the refrigerant distribution characteristics that is caused when the flow rate of refrigerant varies can be reduced, and deterioration of the heat exchange performance can thus be reduced.

When the outdoor heat exchanger 10 operates as a condenser, first, the refrigerant flows into the gas header distributor 13. Then, the refrigerant exchanges heat with air to condense and liquefy, and flows out of the liquid header distributor 12. The refrigerant that has flowed out of the liquid header distributor 12 flows into the subcooling heat exchanger 15. Then, the refrigerant exchanges heat with air to change into single-phase liquid refrigerant, and flows out of the subcooling heat exchanger 15. In this case, the flow velocity of the refrigerant in the subcooling heat exchanger 15 is increased. As a result, the heat exchange performance can be improved.

<Advantages of Embodiment 5>

According to Embodiment 5, the outdoor heat exchanger 10 is provided with the subcooling heat exchanger 15 that is connected to the outdoor heat exchanger 10. The subcooling heat exchanger 15 is located upstream of the outdoor heat exchanger 10 in the direction in which the refrigerant flows when the outdoor heat exchanger 10 operates as an evaporator.

In the above configuration, the quality of the two-phase gas-liquid refrigerant that flows into the liquid header distributor 12 is higher than in the case where the subcooling heat exchanger 15 is not provided. Therefore, the flow velocity of the gas phase refrigerant is increased, thereby also increasing the flow velocity of the liquid phase refrigerant. Accordingly, the flow resistance in the liquid header distributor 12 is reduced, as compared with the flow resistance in the heat transfer tubes 11. As a result, the ratio of the flow resistance in the liquid header distributor 12 to the flow resistance in the heat transfer tubes 11 is small. Thus, the influence of the flow resistance in the liquid header distributor 12 on the distribution of the refrigerant can be reduced. Therefore, an adverse effect on the refrigerant distribution characteristics that is caused when the flow rate of refrigerant varies can be reduced, and deterioration of the heat exchange performance can thus be reduced. When the outdoor heat exchanger 10 operates as a condenser, first, the refrigerant flows into the gas header distributor 13. Then, the refrigerant exchanges heat with air in the heat transfer tubes 11 to condense and liquefy, and flows out of the liquid header distributor 12. The refrigerant that has flowed out of the liquid header distributor 12 flows into the subcooling heat exchanger 15. Then, the refrigerant exchanges heat with air to change into single-phase liquid refrigerant, and flows out of the subcooling heat exchanger 15. In this case, the flow velocity of the refrigerant in the subcooling heat exchanger 15 is increased, and the heat exchange performance can thus be improved.

Embodiments 1 to 5 of the present disclosure may be combined when being applied, or may be applied to other configures.

REFERENCE SIGNS LIST

10: outdoor heat exchanger, 11: heat transfer tube, 12: liquid header distributor, 13: gas header distributor, 14: heat exchanger core, 15: subcooling heat exchanger, 16: U-shaped bent portion, 30: indoor heat exchanger, 31: expansion device, 32: accumulator, 33: compressor, 34: four-way valve, 35: refrigerant pipe, 36: outdoor fan, 40: tube-shaped conversion joint, 41: branch tube, 100: air-conditioning apparatus, 101: outdoor unit

The invention claimed is:

1. An outdoor unit comprising:

a fan configured to send an outdoor air; and a heat exchanger that operates as an evaporator configured to cause heat exchange to be performed between refrigerant being in a two-phase gas-liquid state and the outdoor air to evaporate the refrigerant, wherein the heat exchanger includes a plurality of heat transfer tubes, a liquid header distributor to which one end of each of the plurality of heat transfer tubes is connected and in which an upward flow of the refrigerant being in the two-phase gas-liquid state is generated, the liquid header distributor being configured to distribute the refrigerant being in the two-phase gas-liquid state to the plurality of heat transfer tubes, and a gas header distributor to which an other end of each of the plurality of heat transfer tubes is connected, in which the refrigerant being in a gas-phase state is collected, the refrigerant being in the gas-phase state being refrigerant into which the refrigerant being in the two-phase gas-liquid state evaporates in the plurality of heat transfer tubes to change, and in which a flow of gas phase refrigerant is generated, wherein the plurality of heat transfer tubes include respective U-shaped bent portions at each of which a flow passage is bent, wherein the heat exchanger further includes a heat exchanger core that includes the plurality of heat transfer tubes and one or more fins, wherein in the heat exchanger core, of the plurality of heat transfer tubes, at least one heat transfer tube located at an upper portion of the liquid header distributor includes a larger number of U-shaped bent portions than at least one heat transfer tube located at a lower portion of the liquid header distributor, wherein a relationship between the liquid header distributor and the plurality of heat transfer tubes is established such that $9 \leq \zeta$ is satisfied, where Lh [m] is a length of the liquid header distributor that corresponds to a distance between a central axis of one of the plurality of heat transfer tubes that is the closest to an inlet of the liquid header distributor and a central axis of one of the plurality of heat transfer tubes that is the farthest from the inlet of the liquid header distributor, Lb [m] is a length of a shortest one of the plurality of heat transfer tubes, the length Lb of the shortest one of the plurality of heat transfer tubes corresponding to a distance by which the shortest one of the plurality of heat transfer tubes, which extends from the liquid header distributor to the gas header distributor through the heat exchanger core and the U-shaped bent portions, extends through the heat exchanger core, and $\zeta$ is a ratio of the length Lb of the shortest one of the plurality of heat transfer tubes to the length Lh of the liquid header distributor and is expressed by $\zeta$=Lb/Lh, the outdoor unit having a top-flow housing in which an air velocity is higher at the upper portion of the liquid header distributor than that at the lower portion of the liquid header distributor, the upper portion of the liquid header distributor being relatively close to the fan, and wherein the at least one heat transfer tube including the larger number of U-shaped bent portions is located at the upper portion of the liquid header portion and the air velocity at the upper portion of the liquid header portion is higher than that at the lower portion of the liquid header distributor.

2. The outdoor unit of claim 1, wherein the relationship between the liquid header distributor and the plurality of heat transfer tubes is established such that $9 \leq \zeta \leq 23$ is satisfied.

3. The outdoor unit of claim 1, wherein the U-shaped bent portions of the plurality of heat transfer tubes are located outside the heat exchanger core.

4. The outdoor unit of claim 1, wherein a flow pattern of the refrigerant that flows in a two-phase gas-liquid state and upward through the liquid header distributor is an annular flow or a churn flow in which gas refrigerant flows through a central region of the liquid header distributor and liquid refrigerant flows along an inner wall surface of the liquid header distributor.

5. The outdoor unit of claim 1, wherein a reference apparent gas velocity UGS [m/s], which is a maximum value in a variation range of an apparent gas velocity of the refrigerant that flows into the liquid header distributor, satisfies $$UGS \geq \alpha \times L \times (g \times D)^{0.5}/(40.6 \times D) - 0.22 \times \alpha \times (g \times D)^{0.5},$$

where $\alpha$ is a void fraction of the refrigerant, L [m] is an entrance length of an inlet portion of the liquid header distributor, g [m/s$^2$] is a gravitational acceleration, and D [m] is an inside diameter of the liquid header distributor, and the void fraction $\alpha$ of the refrigerant is expressed by $\alpha = x/(x \pm (\rho G/\rho L) \times (1-x))$, where x [−] is a quality of the refrigerant, $\rho$G [kg/m$^3$] is a gas refrigerant density, and $\rho$L [kg/m$^3$] is a liquid refrigerant density.

6. The outdoor unit of claim 1, wherein a reference apparent gas velocity UGS [m/s], which is a maximum value in a variation range of an apparent gas velocity of the refrigerant that flows into the liquid header distributor, satisfies $$UGS \geq 3.1/(\rho G^{0.5}) \times [\sigma \times g \times (\rho L - \rho G)]^{0.25},$$

where $\rho$G [kg/m$^3$] is a gas refrigerant density, $\rho$L [kg/m$^3$] is a liquid refrigerant density, and a [N/m] is a surface tension of the refrigerant.

7. The outdoor unit of claim 1, wherein the heat exchanger core is provided to allow air to flow through the heat exchanger core such that a component of a flow velocity of the air in a horizontal direction is larger than a component of a flow velocity of the air in a vertical direction, and wherein the fan is configured to send air in a direction along a rotational axis of the fan, a rotational plane of the fan being inclined at an angle of 45 degrees or less relative to a horizontal plane.

8. The outdoor unit of claim 1, wherein the heat exchanger is divided into two or more sections, and wherein each of the two or more sections of the heat exchanger includes the plurality of heat transfer tubes, the liquid header distributor, and the gas header distributor.

9. The outdoor unit of claim 1, wherein at least one of the plurality of heat transfer tubes is connected to the liquid header distributor or the gas header distributor by a tube-shaped conversion joint.

10. The outdoor unit of claim 1, wherein both or either one of the liquid header distributor and the gas header distributor is divided into two or more sections.

11. The outdoor unit of claim 1, wherein the liquid header distributor is provided at a lower position than the gas header distributor.

12. The outdoor unit of claim 1, further comprises a subcooling heat exchanger connected to the heat exchanger, and wherein the subcooling heat exchanger is provided upstream of the heat exchanger in a direction in which the refrigerant flows when the heat exchanger operates as an evaporator.

13. An air conditioning apparatus comprising the outdoor unit of claim 1, the air-conditioning apparatus being applied to heating of an indoor space.

* * * * *